US008678839B2

(12) United States Patent
Reed et al.

(10) Patent No.: US 8,678,839 B2
(45) **Date of Patent: *Mar. 25, 2014**

(54) HORIZONTALLY CONFIGURED CONNECTOR

(75) Inventors: Bruce Reed, Maumelle, AR (US); Harold Keith Lang, Cary, IL (US); Kent E. Regnier, Lombard, IL (US); Jay Neer, Boca Raton, FL (US)

(73) Assignee: Molex Incorporated, Lisle, IL (US)

( * ) Notice: Subject to any disclaimer, the term of this patent is extended or adjusted under 35 U.S.C. 154(b) by 26 days.

This patent is subject to a terminal disclaimer.

(21) Appl. No.: 13/532,985

(22) Filed: Jun. 26, 2012

(65) Prior Publication Data

US 2012/0264325 A1 Oct. 18, 2012

Related U.S. Application Data

(63) Continuation of application No. 13/062,240, filed as application No. PCT/US2009/056294 on Sep. 9, 2009, now Pat. No. 8,241,045.

(60) Provisional application No. 61/095,450, filed on Sep. 9, 2008, provisional application No. 61/110,748, filed on Nov. 3, 2008, provisional application No. 61/117,470, filed on Nov. 24, 2008, provisional application No. 61/153,579, filed on Feb. 18, 2009, provisional application No. 61/170,956, filed on Apr. 20, 2009, provisional application No. 61/171,066, filed on Apr. 20, 2009, provisional application No. 61/171,037, filed on Apr. 20, 2009.

(51) Int. Cl.
*H01R 12/00* (2006.01)

(52) U.S. Cl.
USPC ..... 439/76.1

(58) Field of Classification Search
USPC ..... 439/76.1, 76.2, 357, 358, 493, 625, 626
See application file for complete search history.

(56) References Cited

U.S. PATENT DOCUMENTS

| | | | | |
|---|---|---|---|---|
| 4,611,887 | A | 9/1986 | Glover et al. | |
| 5,421,746 | A | 6/1995 | David | |
| 7,160,135 | B1 | 1/2007 | Wu | |
| 7,281,937 | B2 | 10/2007 | Reed et al. | |
| 7,318,740 | B1 | 1/2008 | Henry | |
| 7,534,125 | B1 | 5/2009 | Schroll | |
| 7,736,171 | B2 | 6/2010 | Reed et al. | |
| 8,241,045 | B2 * | 8/2012 | Reed et al. | 439/76.1 |

FOREIGN PATENT DOCUMENTS

| | | |
|---|---|---|
| CN | 201845897 U | 5/2011 |
| JP | 04-006186 U | 1/1992 |
| JP | 11-224742 | 8/1999 |
| JP | 2004-319371 | 11/2004 |

OTHER PUBLICATIONS

International Search Report for PCT/US2009/056294.

* cited by examiner

*Primary Examiner* — Khiem Nguyen
(74) *Attorney, Agent, or Firm* — Stephen L. Sheldon

(57) ABSTRACT

A connector of horizontal construction includes at least a pair of first and second halves that are mated together along a common mating line. A plurality of mating blades are supported in a vertical arrangement within a mating portion of the connector. The connector includes two distinct fasteners for holding the housing halves together. A fastener can be provided as a horizontal attachment member that extends widthwise in the mating portion in a space between the circuit cards. A second fastener can be provided as an exterior retainer that engages at least part of the outer circumference, or perimeter of the connector.

23 Claims, 33 Drawing Sheets

HORIZONTALLY CONFIGURED CONNECTOR

REFERENCES TO RELATED APPLICATIONS

This application is a continuation of U.S. application Ser. No. 13/062,240, filed May 16, 2011, now U.S. patent No. TBD, which is a national phase of international application PCT/US09/56294, filed Sep. 9, 2009 and claims priority to U.S. Provisional Appln. No. 61/095,450, filed Sep. 9, 2008; to Appln. No. 61/110,748, filed Nov. 3, 2008; to Appln. No. 61/117,470, filed Nov. 24, 2008; to Appln. No. 61/153,579, filed Feb. 18, 2009, to Appln. No. 61/170,956 filed Apr. 20, 2009, to Appln. No. 61/171,037, filed Apr. 20, 2009 and to Appln. No. 61/171,066, filed Apr. 20, 2009, all of which are incorporated herein by reference in their entirety. This application was filed concurrently with the following applications, which are not admitted as prior art to this application and which are incorporated herein by reference in their entirety:

- Application Serial No. PCT/US09/56295, filed Sep. 9, 2009, entitled CONNECTOR WITH INTEGRATED LATCH ASSEMBLY, and which during national phase became U.S. application Ser. No. 13/062,248, filed Mar. 4, 2011;
- Application Serial No. PCT/US09/56297, filed Sep. 9, 2009, entitled HORIZONTALLY CONFIGURED CONNECTOR WITH EDGE CARD MOUNTING STRUCTURE, and which during national phase became U.S. application Ser. No. 13/062,360, filed Jun. 15, 2011.

BACKGROUND OF THE INVENTION

The present invention generally relates to connectors suitable for transmitting data, more specifically to input/output (I/O) connectors suitable for dense connector configurations.

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire for increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O connectors and this is difficult to do without increasing the width of the connectors. Increasing the width of the connectors leads to difficulty in fitting the connector into standard width routers and/or servers, and would require a user to purchase non-standard equipment to accommodate the wider connectors. Accordingly, there is a desire for an improved connector design.

SUMMARY OF THE INVENTION

In one aspect, a connector is provided that has a housing which houses multiple circuit cards to which wires of cables are terminated along the trailing edges thereof. The leading edges of these circuit cards have a plurality of conductive contact pads arranged thereon and they provide points of contact with a plurality of terminals.

The circuit cards in the connector can be arranged in one or more vertical stacks so as not to increase the overall width of the connector, yet still increase the density of available circuits for the connector. The connector may be configured for assembly in the horizontal direction, meaning that in a single connector, left and right housing side members are provided. For multiple connector housings, such as tandem arrangements, left, right and center members are provided. The housing members may be joined together horizontally along upper and lower mating faces that may be coincident with the centerline of an associated connector, or may be offset therefrom. Two means for fastening the housing members together may be provided, one proximate to the front mating portion of the connector and the other proximate to the rear body portion of the connector.

The front fastening means may take the form of a swageable member that extends horizontally between the walls of the various housing members and generally transverse to a longitudinal axis of the connector and having a head that extends through a hole in one of the connector housing halves where it can be swaged to hold the connector housing halves together. The rear fastening means preferably takes the form of a collar that encompasses at least more than half of the circumference of the rear portion of the connector to hold the connector pieces together. In this manner, the two fastening means ensure that the rear housing area of the connector housing near where the cables enter is held together and the front mating area that houses the mating edge cards are held together in a reliable manner. This construction reduces the number of fastening members needed to assemble the connector and reliably hold it together, and their structure does not increase the overall size of the connector.

In another aspect, the connector structure is such that it may be utilized as a ganged or tandem connector without unduly increasing the width of the connector mating portion(s). This is accomplished by utilizing a center piece that is disposed between and mated to the left and right connector housing halves. The center piece includes, at the mating end of the connector, at least one slot that extends rearwardly from a front edge of the center piece in order to divide the front end of the connector into two separate mating portions. Multiple center pieces can be assembled together with the right and left connector halves to expand the number of distinct mating portions of the connector and such expanded connectors can be made virtually any width with the left, center and right pieces taken from a standard inventory of connector parts.

In instances where a connectors utilizes multiple mating portions, the circuit cards in each mating portion can be arranged in a common vertical spacing. Fasteners can be applied to hold the connector housing together and can occupy the intervening space between circuit cards. Adjacent mating portions are identical to each other in that the vertical space(s) separating the circuit cards can be commonly used to accommodate a fastening means.

In yet another aspect, the rear fastening means that retains the connector pieces together includes a continuous retaining band, or collar, that fits over the connector pieces in an encompassing manner. The connector housing may include a channel, or recess, that at least partially extends around the perimeter of the housing and in which the retaining collar is received. The retaining collar may include inwardly depending engagement arms that engage slots formed in the housing recess and abut rear stop surfaces of the slots in order to retain the collar in place on the connector and make the connector housing, for all practical purposes, a unitary connector housing that is permanently held together.

In another embodiment, the rear fastening means may be a C-shaped or a U-shaped retainer that, as with the retaining collar, engages a portion of the circumference of the connector housing. In this structure, the retainer has a backbone portion extending between two free ends. The free ends may include one or more engagement tabs which engage the connector housing. The extent of the retainer between its two free ends is preferably more than one-half the circumference in order to apply compressive force to the connector housing pieces.

In a still further aspect, the connector is provided with multiple mating portions, each such mating portion including at least a pair of top and bottom flanges that flank the mating blades. The mating blades are preferably circuit cards with leading edges that are protected by the flanges of the mating portions and a trailing edge that extends into the interior of the connector housing so that cable wires can be terminated to it. The circuit cards are stacked in the mating portions in a vertical array, i.e. one circuit card is separated from another circuit card by an intervening space. With this vertical stacking, it is possible to achieve an increased connector density without increasing the width. The left and right connector halves may be fastened together by fasteners that extend horizontally in the intervening vertical space between the circuit cards.

BRIEF DESCRIPTION OF THE DRAWINGS

Throughout the course of the following detailed description, reference will be made to the drawings in which like reference numbers identify like parts and in which.

DETAILED DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

In general, the present disclosure provides a connector, which can be a plug connector, having a higher density without unduly increasing the width of the connector. Certain embodiments provide a connector assembled from a plurality of pieces in a horizontal fashion and containing multiple edge cards, oriented horizontally for mating with an opposing connector. An embodiment may include a connector of horizontal construction assembled from at least two distinct pieces, the pieces being at least partially retained together as unit by a first retainer that engages a portion of the circumference of the connector, and a second retainer that extends sideways between the two connector pieces and in between the edge cards.

Regarding the connector disclosed herein, as can be appreciated, a wide range of possible configurations may be used and various embodiments of possible connectors are illustrated in the figures. As can be appreciated, the connector configurations include a fastener positioned between two parallel circuit cards. The fastener holds the connectors housing together and depending on its location, the fastener can also be used to stop to prevent over insertion of the connector into a mating connector (thus helping prevent excessive forces from being applied to the terminals and/or the circuit cards).

Figure 8:
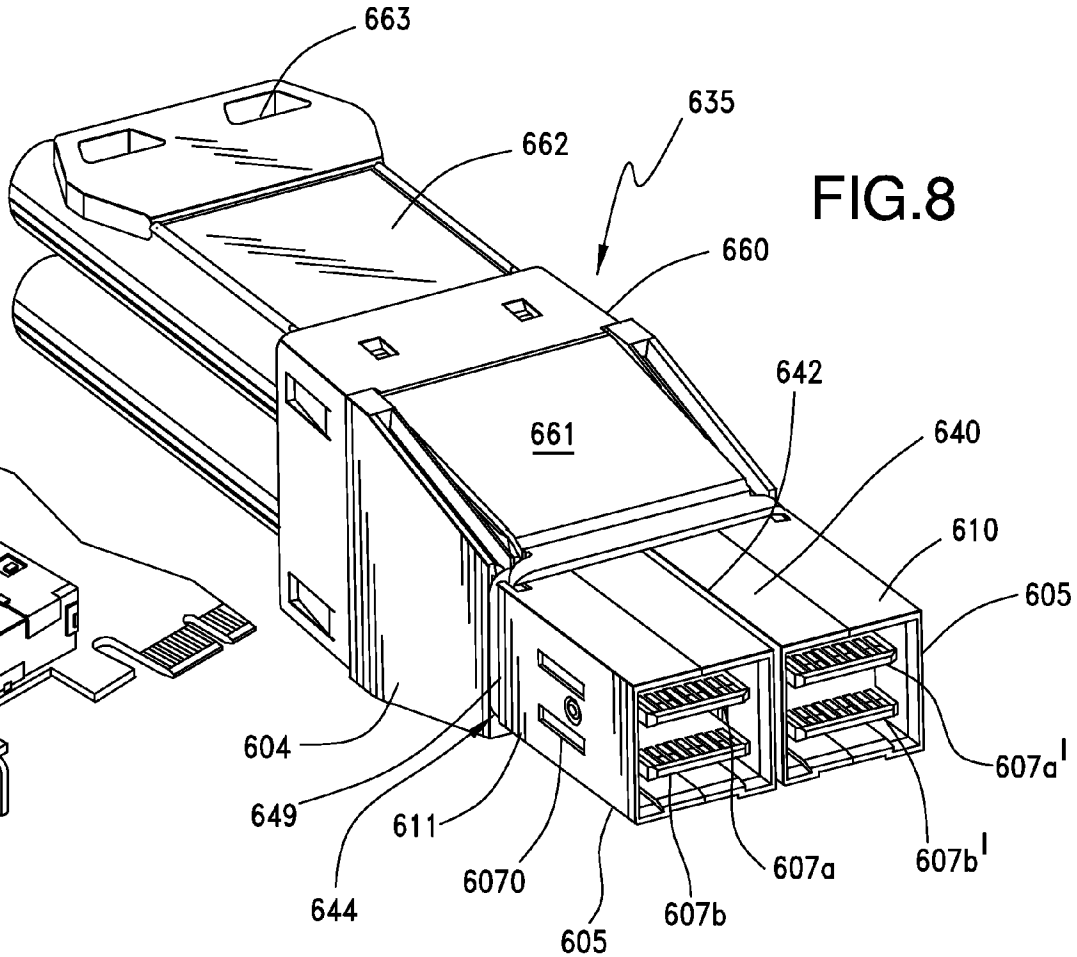
FIG. 8 is a perspective view of a tandem connector.
Figure 8A:
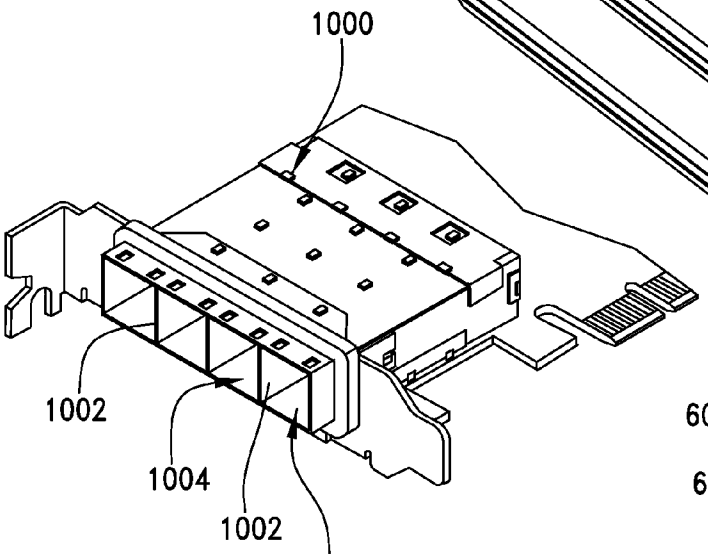
FIG. 8A is a perspective view of a 1×4 receptacle connector assembly with which the tandem connector of FIG. 8 mates.
Figure 9:
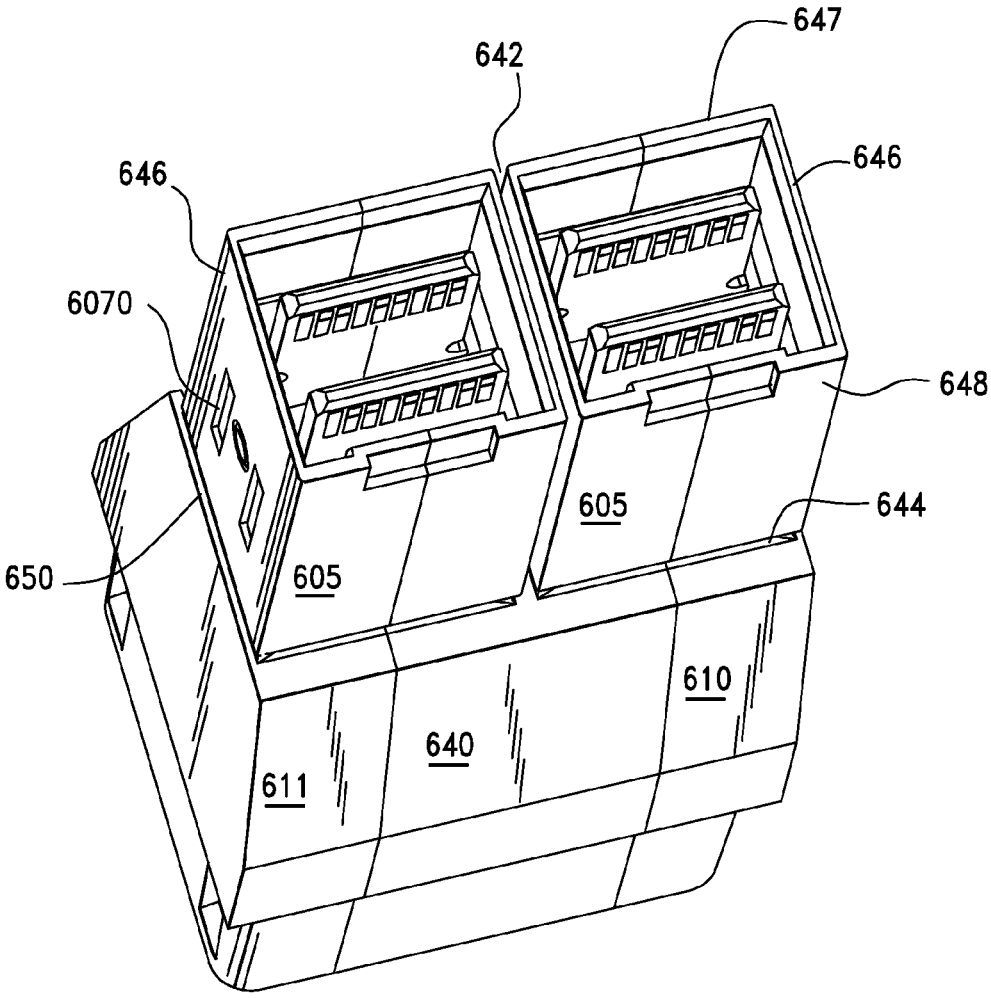
FIG. 9 is a perspective view of the connector of FIG. 8 taken from the front underside thereof.
Figure 10:
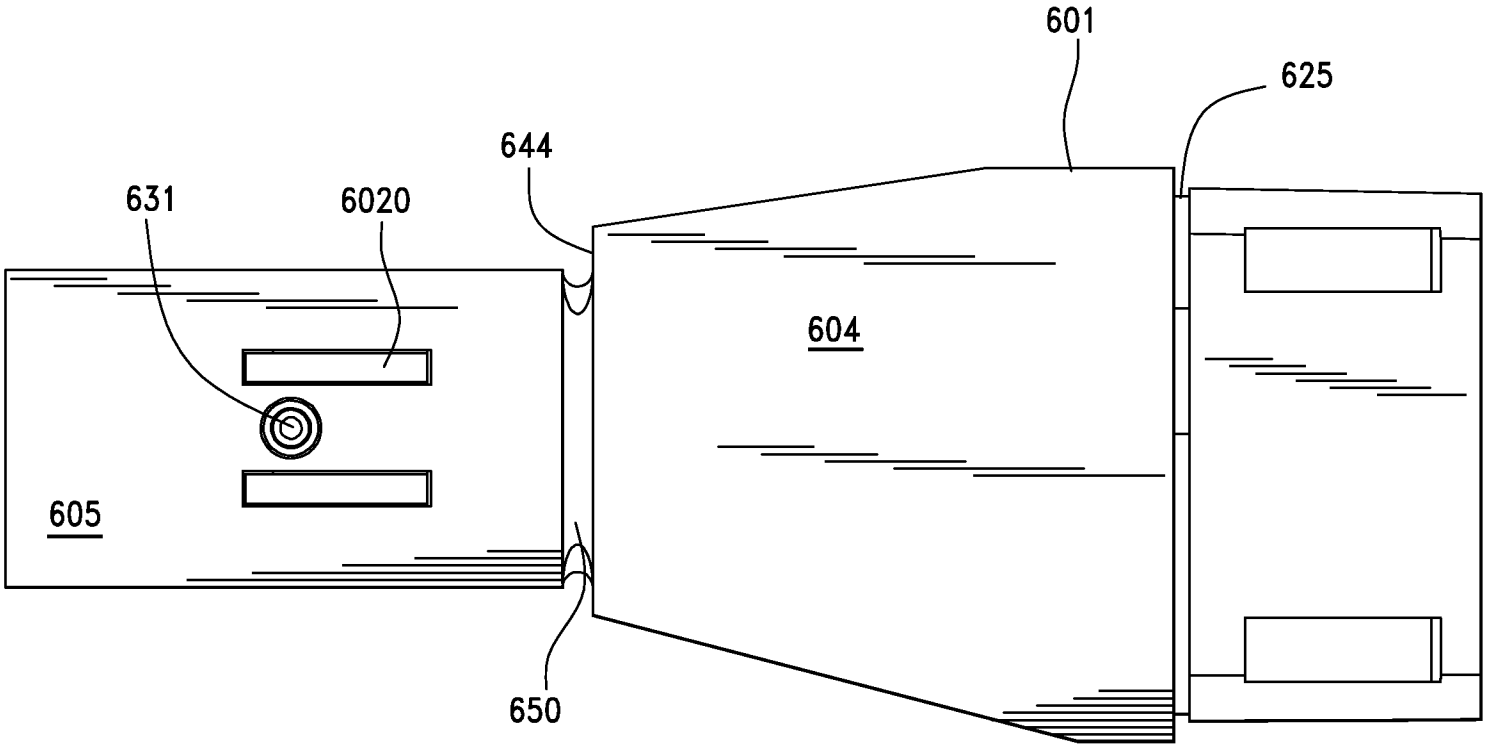
FIG. 10 is a side elevational view of the connector of FIG. 8.
Figure 11:
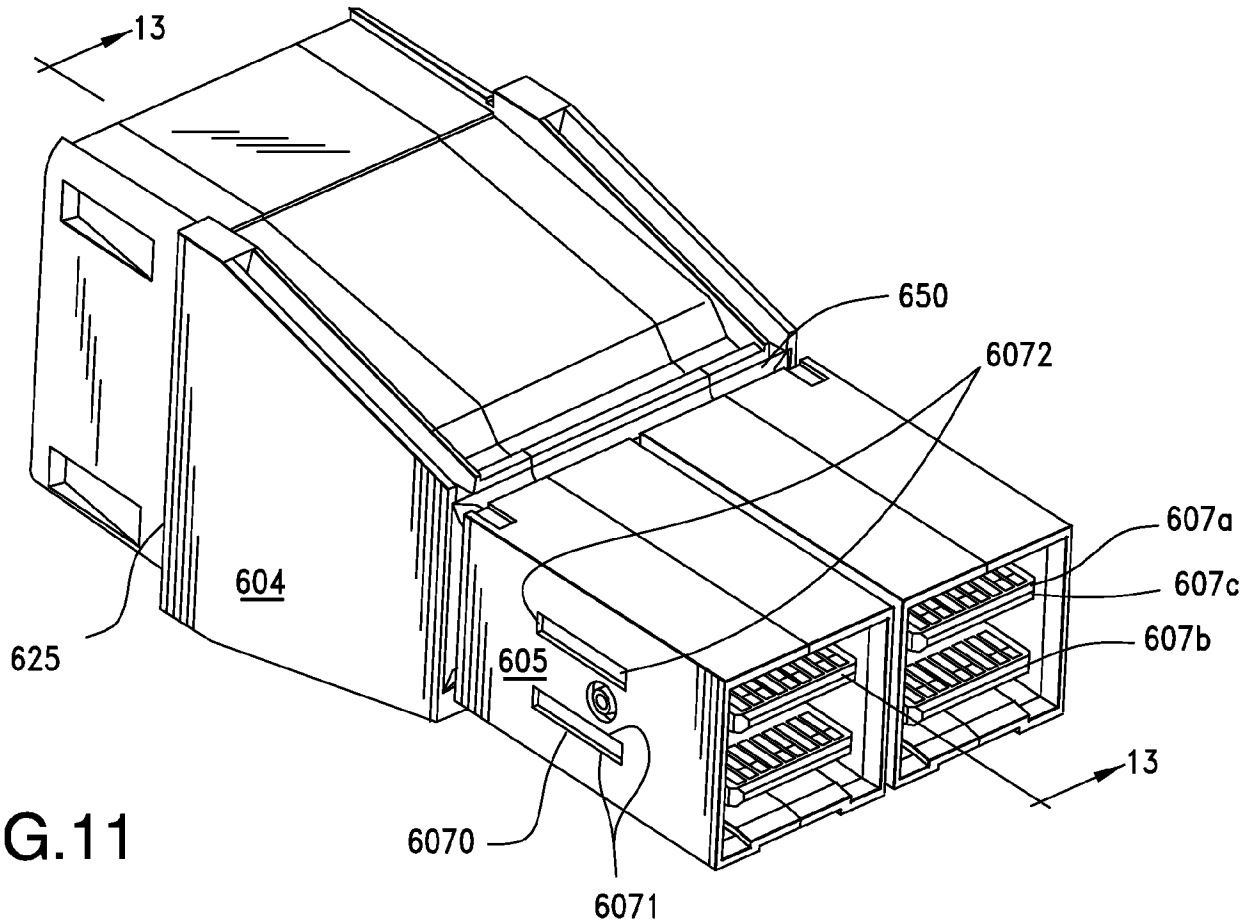
FIG. 11 is the same view as FIG. 8, but with the cables and latching assembly removed for clarity.
Figure 12:
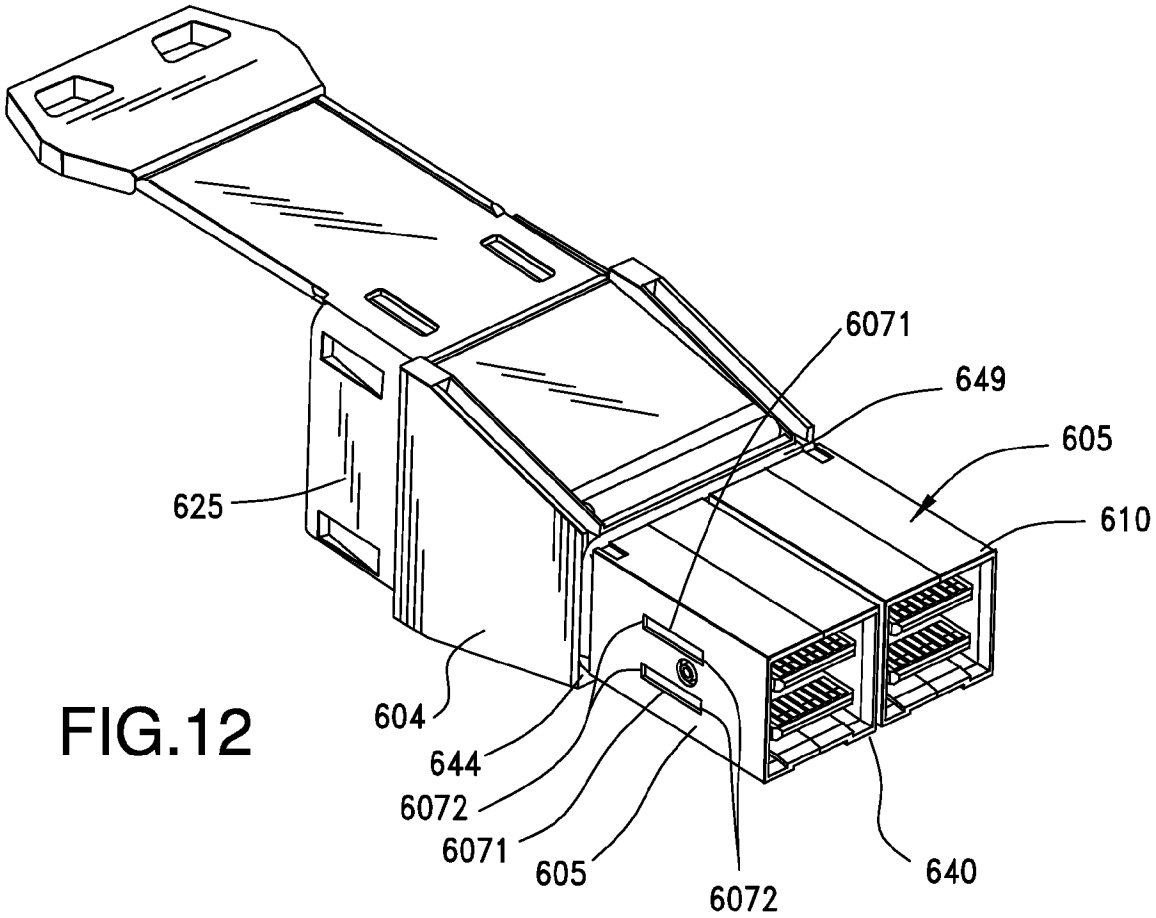
FIG. 12 is the same view of FIG. 11, but with the latching assembly actuator illustrated in place upon the connector housing.

As can be appreciated, this allows the circuit cards position to be controlled with a high degree of precision while minimizing component costs. And as the portion of the connector with the circuit cards will be positioned inside the mating receptacle, shielding issues are not created. As can be further appreciated, a three-piece housing may be used to provide for a ganged assembly such as would be suitable for mating with two ports in a ganged connector such as the ganged connector shown in FIG. 8A.

FIGS. 1-7 illustrate a first embodiment of a connector 600. The connector 600 is seen to have a hollow connector housing 601 with an enlarged body portion 604 and an elongated mating portion 605, having a hollow interior recess 606 that supports a pair of mating blades (or circuit cards) 607 therein to which individual wires 616 held in cables 615 are terminated. It should be noted that while circuit cards are referred to herein for convenience of discussion, the mating blades are not so limited and could be, for example, a plated plastic or the like. For many applications, however, circuit cards are a cost effective solution. The circuit cards 607 mate with and engage conductive terminals of an opposing mating connector in order to connect the terminals to the wires 616 of the cables 615. In this regard, the circuit cards 607 take the form of what are known in the art as "paddle cards" and, as disclosed, are arranged in vertically-spaced apart manner and are preferably parallel to each other. In this manner, the number of circuits in the connector 600 to connected to an opposing mating connector, (not shown) is increased (in the configuration illustrated, the number is doubled) without increasing the widthwise dimensions of the connector 600. In this regard, it should be noted that while two circuit cards are illustrated, in an embodiment the connector could be readily configured to accept three or more circuit cards in a similar fashion. The vertical orientation of the connector housing body portion 604 permits the wire cables 615 to which the connector 600 is terminated to be arranged vertically, preferably one above another so that the width of the connector is not increased. As noted below, the connector housing 601 is provided with a specially configured rear end in order to reliably grip the cables 615 and hold them in their preferred vertical orientation. It should be noted that while two wire cables are depicted (e.g., one for each circuit card), a single wire cable could also be used, provided a sufficiently small enough gauge of wire was used. As can be appreciated, retention features that are used for a connector that includes two wire cables can also be used for a single wire cable.

Figure 13:
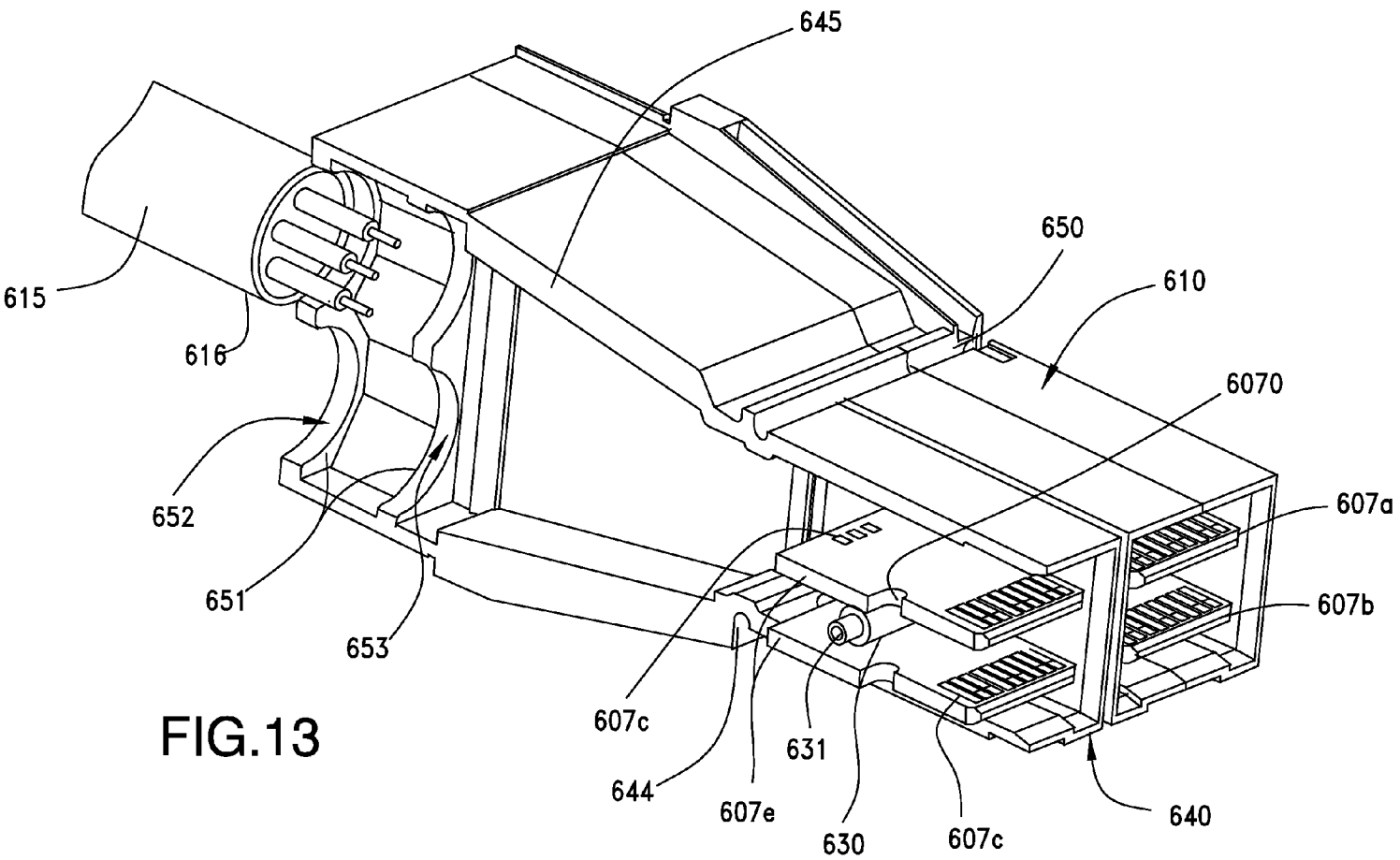
FIG. 13 is a sectional view of the connector of FIG. 11, with the right housing half removed.
Figure 14:
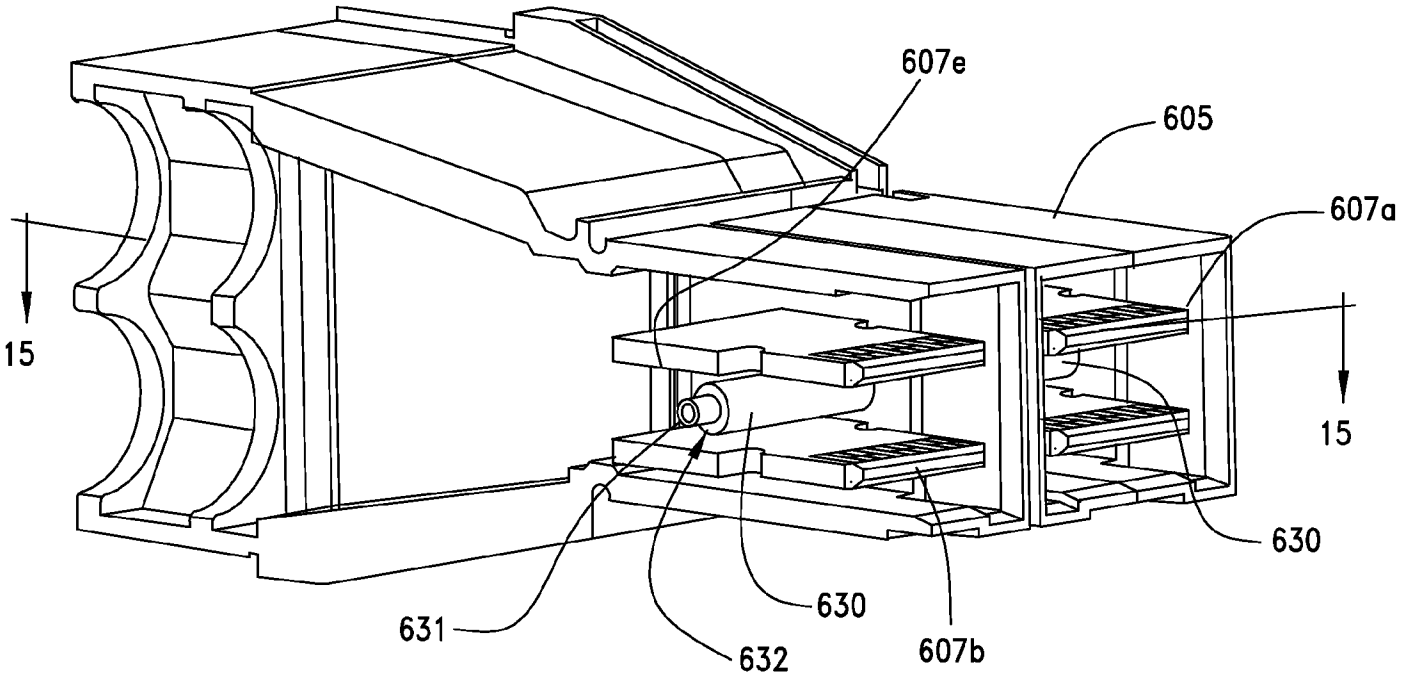
FIG. 14 is the same as FIG. 13 but taken from a different angle.

The connector housing body portion 604 is larger in size than its adjacent narrow mating portion 605, particularly in the height dimension. As such, the body portion 604 has a greater height than that of the mating portion 605. The interior of the connector housing 601 includes a hollow interior cavity 602, as shown best in FIGS. 7 and 13. The interior cavity 602 occupies most of the connector housing 601, particularly the body portion 604 thereof, but it communicates with the hollow interior recess 606 defined within the connector housing mating portion 605.

The connector housing 601 is formed from two distinct parts, shown as housing halves 610, 611 which are respectively arranged as left and right, or first and second, housing halves. If desired, the housing halves 610, 611 may be mirror images of each other. These housing halves 610, 611 are assembled together in the horizontal, or widthwise, direction and are retained together along opposing mating faces, or vertical lines, by at least two distinct fastening means. The front fastening means 612 is disposed proximate the connector housing mating portion 605, while the rear fastening means is preferably disposed at the connector housing body portion. It can be appreciated from the Figures, both fastening means apply a widthwise retaining force on the connector housing 601 that maintains the first and second connector housing halves 610, 611 thereof together in mating engagement. This retaining force is desirably a compressive, or clamping, force which holds the two connector housing halves in contact with each other along opposing vertical mating faces that extend longitudinally through the connector housing 601. As shown in the embodiment of FIGS. 1-7, the mating faces are aligned along a vertical axis and are coincident with a longitudinal centerline of the connector, but it will be understood that such a mating line may be offset, i.e., the bottom edge of the first connector housing half 610 may extend further than the edge thereof, as shown in the embodiment illustrated FIGS. 27-31.

Figure 7:
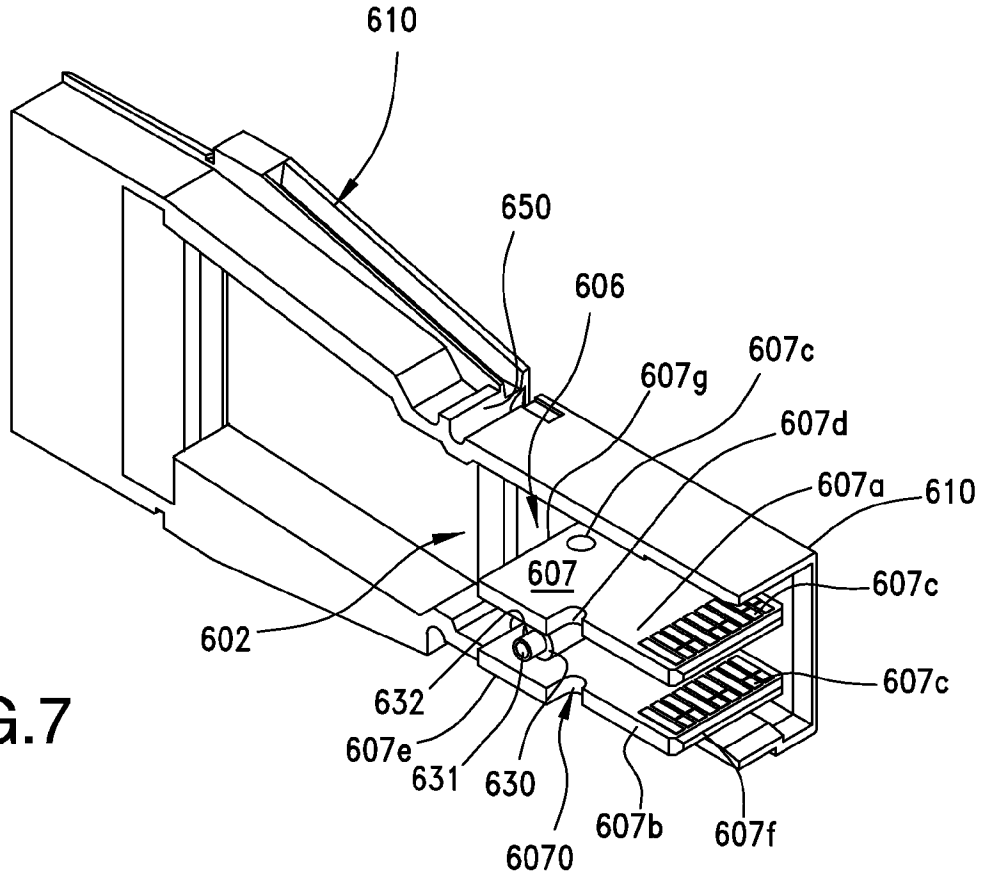
FIG. 7 is a partially exploded view of the left side of the connector housing of the connector of FIG. 1.

In order to apply the desired retaining force at the mating portion 605 of the connector, the front fastening means may include a horizontally extending fastening post 630. (FIG. 7.) This post may be cylindrical or square. The housing halves lend themselves to being manufactured by a casting process and as such, the fastening post 630 may be integrally cast with one of the housing halves 610. The post 630 shown has a narrow swaging lug 631 at its free end 632 that is preferably received in a corresponding opening 633 formed in the opposing connector housing half 611. When the housing halves are assembled together, the lug 631 is swaged, or dead-headed, within the opening to effect a connection. Preferably, the post 630 is integrally formed with one of the housing halves 610 for ease of manufacture and assembly, although alternatively, conventional separate fastener members, such as a screw and threaded boss or rivet, may be used.

In the embodiment illustrated, the front fastening means 612 is preferably located in the vertical, intervening space that is disposed between the two circuit cards 607*a*, 607*b* and advantageously, does not increase the overall height of the connector housing mating portion 605 but takes advantage of the space used to separate the two circuit cards 607*a*, 607*b*. The circuit cards 607*a*, 607*b* have contact pads 607*c* arranged along their leading edges 607*f* for connection to terminals of an opposing mating connector and along the trailing edges 607*g* for connection to wires 616 of the cables 615 terminated to the connector. As seen in FIG. 7, locating the front fastening post 630 between the two circuit cards 607*a*, 607*b* also permits the post 630 to act as a stop that limits the extent to which the connector 600 can be inserted into an opposing receptacle connector.

As noted above, the connector housing body portion 604 is larger than the housing mating portion 605, specifically with respect to its height. This is beneficial in that it permits the cables 615 to be stacked, or arranged vertically, as they enter the body portion at the rear of the connector housing 601. In this manner, the increase in density of circuits in the connector 600 does not result in an increase in the width of the connector. In this regard, the connector housing body portion 604 preferably has a configuration of an irregular polygon, with a trapezoidal-type configuration being shown in FIGS. 1-15, although regular polygons such as rectangular bodies or the stepped configuration of the embodiment of FIGS. 27-31, may also be used.

The circuit cards 607 may themselves include means for orienting themselves within the mating portion hollow interior 606 and for engaging the housing halves 610, 611. These means can take the form of notches 607*d* that are formed in opposite sides of the cards 607 that receive lugs or columns, (not shown) that may be formed in the inner surface of the housing halves 610, 611. The notches 607*d* may also be utilized in embodiments where the connector body portion is molded over the circuit cards 607*a, b*. In this instance, the molding material will flow into and fill the notches 607*d* to hold them in place, especially in the horizontal direction.

Such means can also take the form of wings, or tabs 607*e*, that project outwardly widthwise from the body portions of the circuit cards and which may be received in slots 6070 formed in the housing halves 610, 611. These circuit card wings 607*e* are received in corresponding slots 6070 formed in the connector housing halves 610, 611. The wings 607*e* have a widthwise dimension that is enough to provide reliable support in the connector housing and can cause the circuit card to be wider at the wings 607*e*, than at the leading edges of the circuit cards, but preferably are not large enough so that the edges of the wings project excessively past the outer side surfaces of the connector housing mating portion(s) 605. In practice, a distance of about 1.5 mm (0.045 in.) has provided reliable support.

Figure 15:
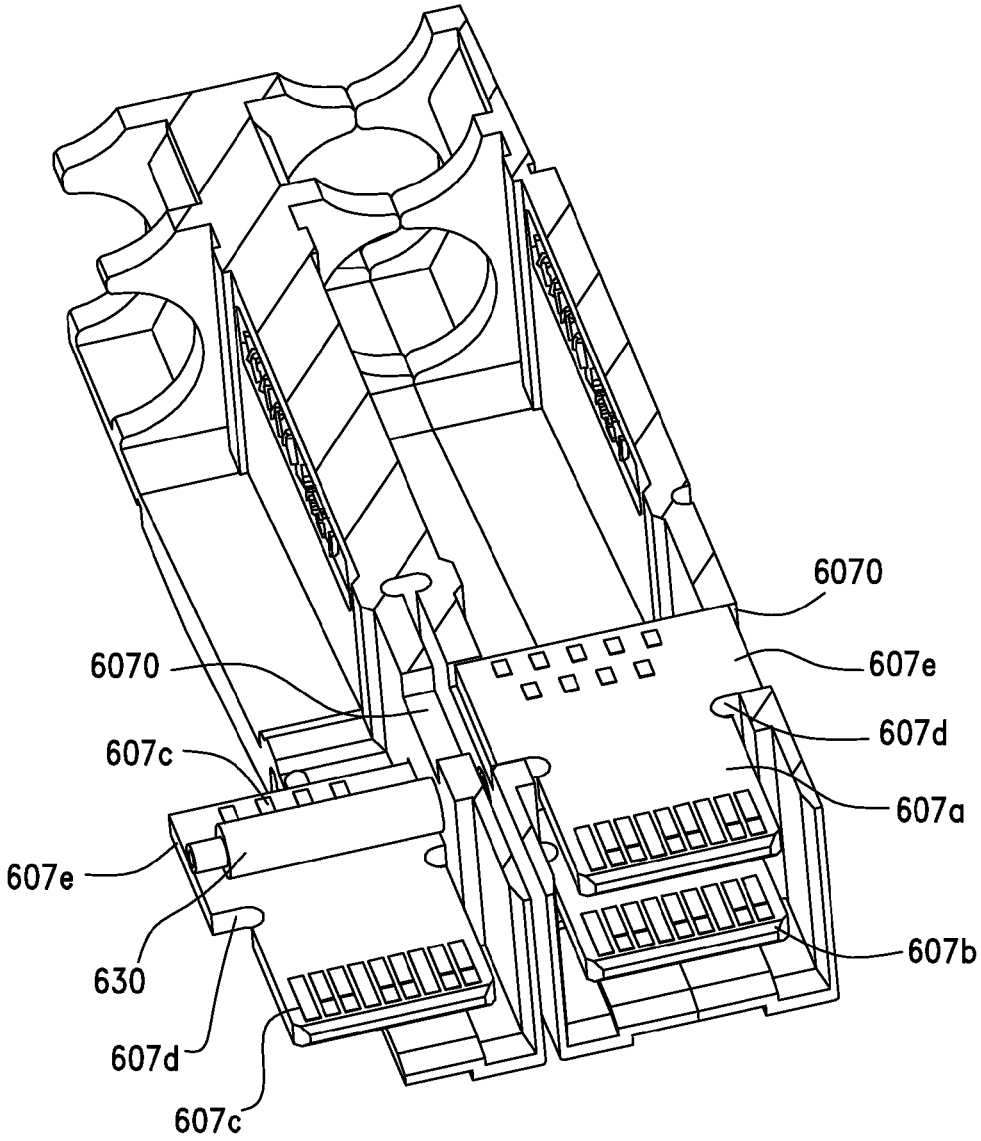
FIG. 15 is a sectional view of FIG. 14, taken along lines 15-15 thereof.
Figure 15A:
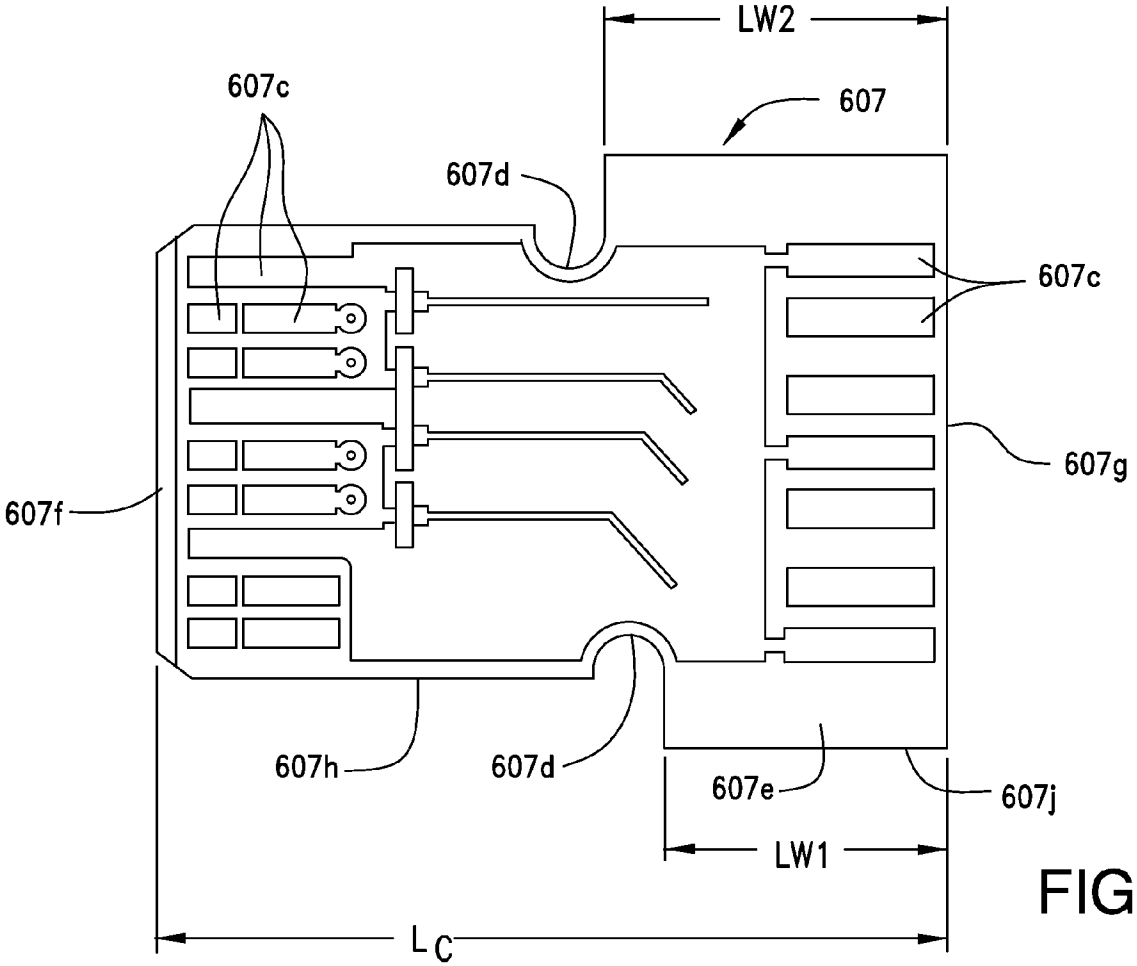
FIG. 15A is a plain view of a circuit card used in connectors of the invention.

The use of such a wing-slot arrangement also facilitates a reduction in the width of such a connector as compared to a connector that uses horizontal support edges on the interior of the connector housing. In such a connection, due to the conductive nature of the die cast housing, the width of the circuit cards would need to be increased in order to keep circuitry thereupon from coming into contact with any supports. As disclosed, the wings 607*e* extend into the connector housing sidewalls via the slots 6070 without fear of any shorting contact from occurring. Also, as illustrated in FIG. 15A, the circuit card wings 607*e* may have different lengths, LW1 & LW2, which are less than the length Lc of the cards and the notches 607*d* positioned at the intersection of the front edges of the wings 607*e* and the circuit card body portion edges are offset from each other. This provides a polarizing aspect to facilitate the correct assembly of the circuit cards 607*a*, 607*b* into the connector 600. This offset distance of the wings 607*e* (and notches 607*d*) permits the circuit cards to be assembled correctly in the housing with their correct sides up, and not upside down.

Additionally, offsetting the notches 607*d* prevents them from being aligned with each other and narrowing the width of the circuit cards in the body portion between the two notches which could result in a weakened structural integrity of the circuit cards. Still further, the notches 607*d* are positioned on the circuit cards 607 at the intersection of the wings 607*e* with the side edges 607*h* of the body portions of the circuit cards 607. In this manner, the front vertical edges of the slots 6085 are able to contact the front edges of the wings. Were the notches not present and a right angle intersection were provided, milled material from the circuit card notches would fill the angled notch and most likely lead to assembly difficulty. In effect, the notches 607*d* act as reentrant portions that eliminate the hard right angle corner where the front edges of the wings 607*e* meet the side edges of the circuit card body portions.

In this embodiment, a retainer 620 also applies a retaining force to the two housing halves 610, 611 which holds them together. The retainer 620 takes the form of a retainer that preferably includes a collar portion 621 that at least partially encircles, and preferably entirely encompasses, the exterior perimeter, or circumference of the connector body portion 604 near the trailing, or proximal end of the connector 600. The terms "circumference" and perimeter" are used herein interchangeably and both refer to an extent around the outer surfaces of the connector housing regardless of the actual configuration of the connector housing 601. The collar portion 621 slips over the body portion 604 and preferably in the form of an interference fit, engages the housing body portion 604 in a manner so as to press the two housing halves together along their opposing mating faces.

Figure 6:
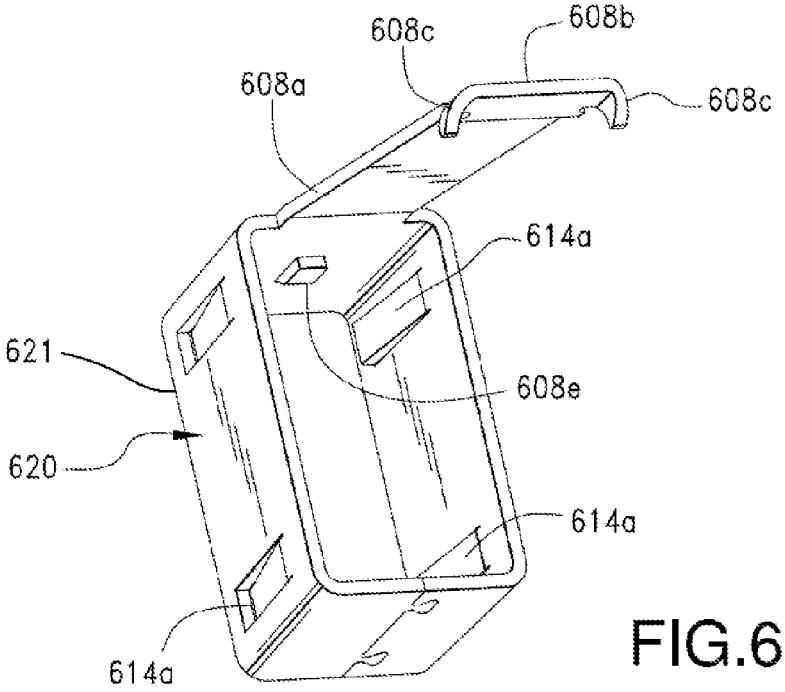
FIG. 6 is a perspective view of the latching assembly of the connector of FIG. 1 taken from the lower front end thereof, and which incorporates a continuous retaining collar as a fastening means.
Figure 6A:
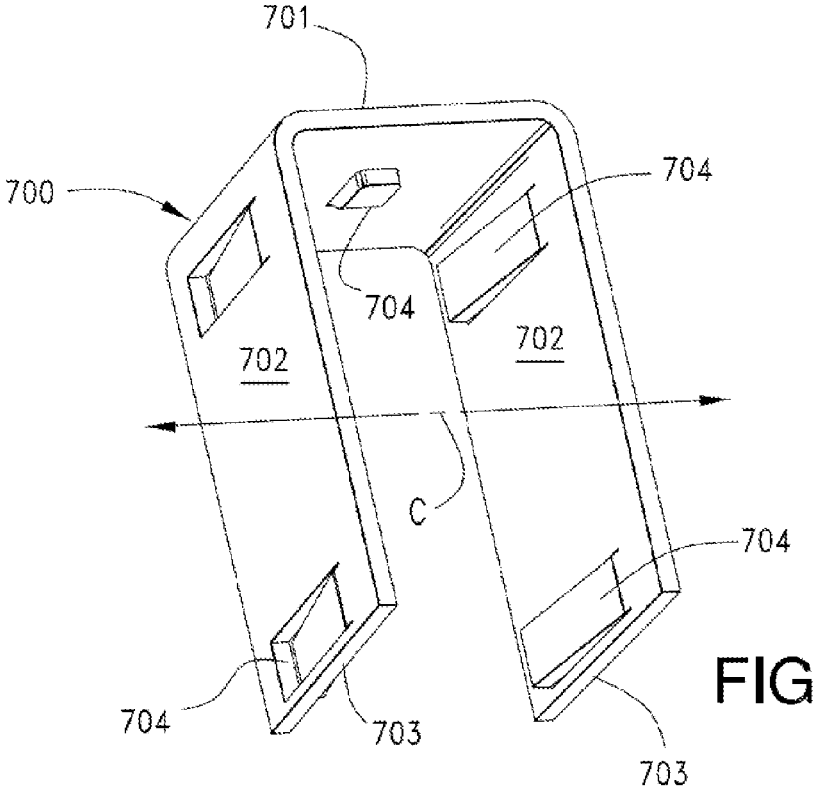
FIG. 6A is a perspective view of another embodiment of a fastening means.

As shown in FIG. 6A, one type of retainer 700 may have a general U-shape with a backbone portion 701 and two leg portions 702 that terminate in free ends 703. Engagement members 704 may be stamped, or otherwise formed, in the retainer 700 in order to 514*b* engage recesses 614*b* formed on the connector housing 601 and particularly in the housing channel 625. The retainer engagement members 704 are shown arranged proximate the free ends 703, proximate the junction of the backbone portion 701 to a leg portion 702 and on the backbone portion itself. The length of the leg portions 702 in such that the retainer 700 will desirably contact more than one-half of the circumference connector housing so that this style of retainer will exert a clamping force on the two connector housing halves 610, 611. This length can extend past the line "C" shown in FIG. 6*a* which is the midpoint of the leg portion length. The retainer engages the connector housing in a circumferential manner, meaning it engages enough at the circumference to exert a clamping force on the two housing halves 610, 611. As noted, this will typically require that it extend on the connector housing more than one-half of the circumference, but it will be noted that in square or rectangular housings, engagement of three of the four sides will provide a clamping force. It is preferred, as shown in FIG. 6A that the retainer leg portions have at least some engagement members 704 near their free ends. It is preferred that the engagement members of the retainer are disposed on opposite sides of a longitudinal centerline of the connector housing. The retainers 620 and 700 of FIGS. 6 and 6A engage at least three adjacent sides of the connector housing.

Figure 6B:
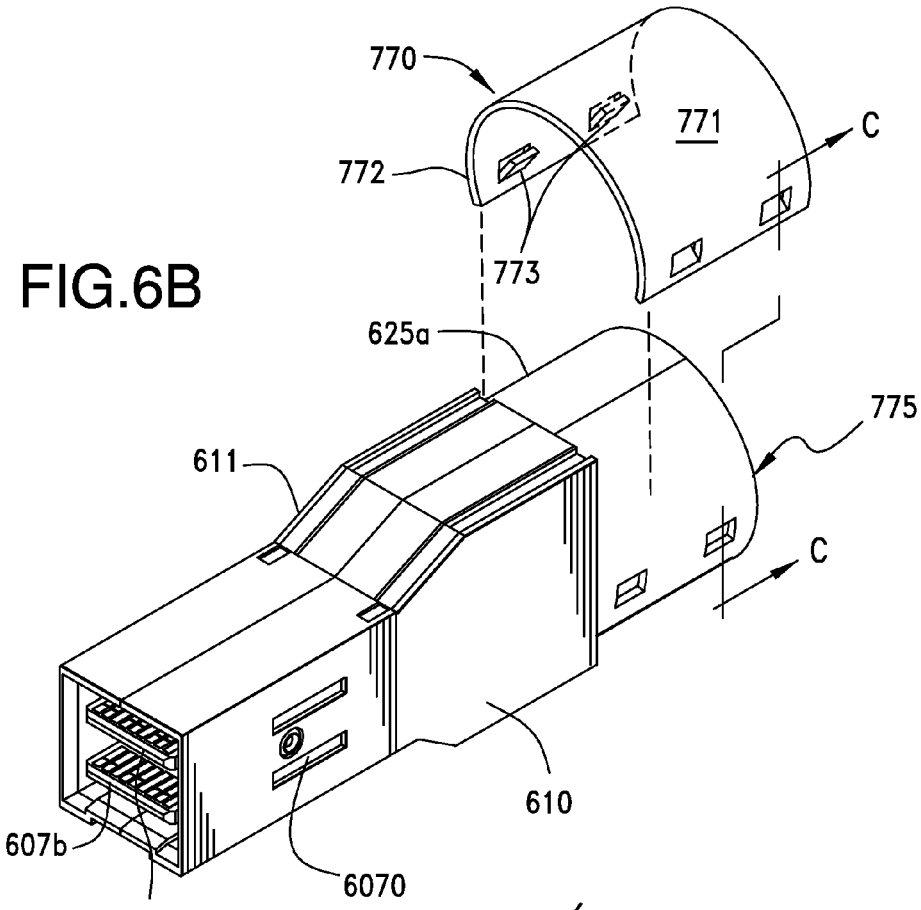
FIG. 6B is a perspective view of another embodiment of a fastening means.
Figure 6C:
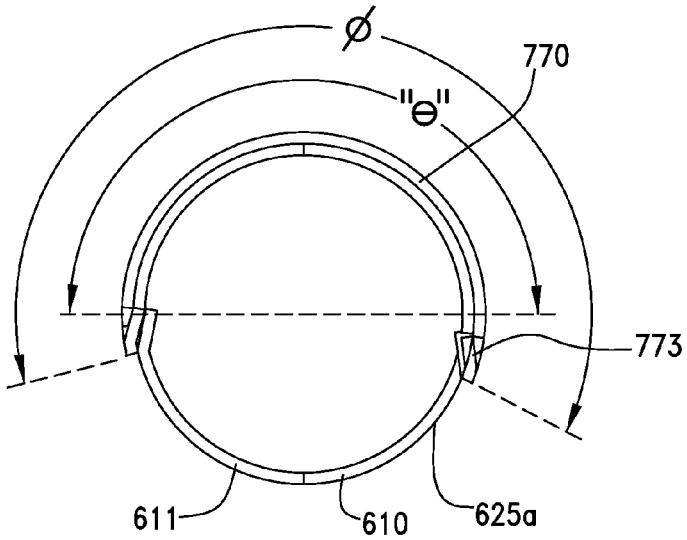
FIG. 6C is a sectional view of FIG. 6B, taken along lines C-C thereof.

Other retainers may also have a more rounded C-shaped configuration, rather than the rectangular and U-shaped configurations illustrated. As illustrated in FIGS. 6B and 6C, the retainer 720 can have a semi-circular or general C-shape with a backbone portion 771 from which extends two arm portions that terminate in free ends 772. These free ends 772 include engagement members shown in the form of tabs 773 that are punched, or otherwise formed, in the collar 770. In this alternate embodiment, the rear end 775 of the connector housing body portion 604 may be cylindrical and include a channel 625 in which the retainer 770 is received. The retainer 770 engages the part of circumference of the connector housing 601, i.e. its outer perimeter, and in order to apply a retaining face to the connector housing halves 610, 611, the arc length "ø" of it (or its length of engagement from one free end to the other) should be greater than 180° (or more than one-half the outer perimeter) as shown diagrammatically in FIG. 6C. One can see the extent to which the free ends 772 extend past the halfway point, represented by "θ" in FIG. 6C.

It has been determined beneficial to configure the connector housing body portions so that it includes a recess, or channel 625 that extends around the perimeter of the body portion to define a channel that receives the retainer 620, 700 or 770. The channel 625 preferably has a depth that is greater than or equal to the thickness of the retainer so that the retainer may be flush with respect to the connector housing outer surface(s) so as to maintain the desired size of the connector. As shown best in FIGS. 3A and 3B, the rear channel 625 is tapered in the widthwise direction. This taper is an inwardly taper that extend in at an angle "AC1" from the point where the channel 625 meets the connector housing body portion 604 and it cooperates with the overlying retainer to provide a desirable clamping force to the connector housing, as explained in more detail below.

Figure 1:
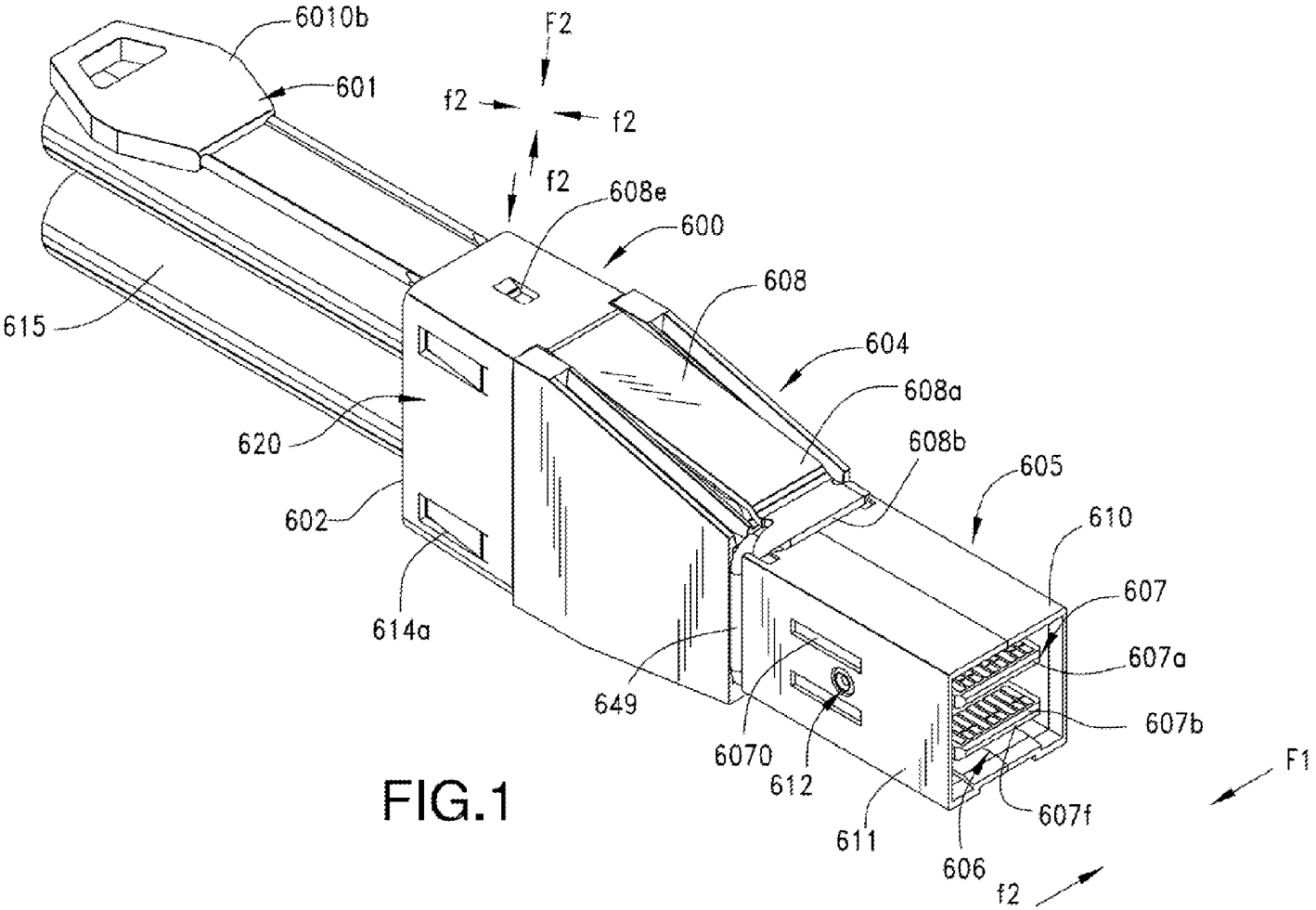
FIG. 1 is a perspective view of one embodiment of a multiple edge card connector.

The first fastening means can be seen to apply a linear fastening force horizontally along the lines F1 in FIG. 1, while the second fastening means applies a circumferential force along the lines F2, in the horizontal and vertical directions along the lines F2 in FIG. 1. The retainers 620 of the connector are also tapered, and such taper is an inward taper in the widthwise direction at an angle "AC2" from a datum line as shown in FIGS. 3A &3B. In order to provide a reliable interference fit and a widthwise clamping force that retains the cables in place within the connector housing body portion, it is preferable that the taper angle AC2 be greater than the taper angle AC1 so that the collar portion 621 of the retainer 620 elastically deforms slightly and undergoes tension while exerting a compressive force on the two housing halves 610, 611. This same compressive force mating arrangement may be provided by utilizing means other than tapers, such by a difference in exterior overall diameter or circumference of the connector housing and the interior overall diameter or circumference of the retaining collar, as well as by other means.

The collar portion 621 may have engagement tabs 614*a*, formed therein, such as by stamping. These engagement tabs 614*a* are preferably formed as illustrated, on opposing extents of the retaining collar and four such tabs 614*a* are illustrated disposed proximate to corners of the retaining collar. Although illustrated as formed in the vertical wall portions thereof, the engagement tabs 614*a* may also be formed in the horizontal wall portions thereof. It is preferred that these engagement tabs 614*a* are disposed on opposite sides of a longitudinal centerline of the connector housing.

Figure 4:
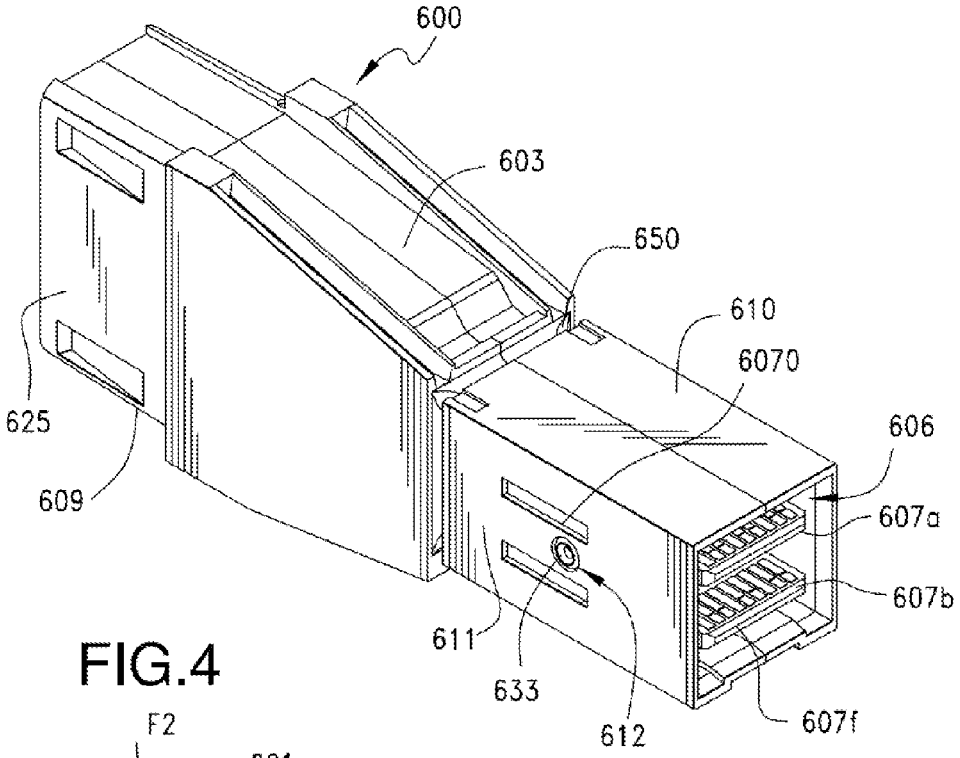
FIG. 4 is the same view as FIG. 3, but with the actuator and cables removed for clarity.
Figure 5:
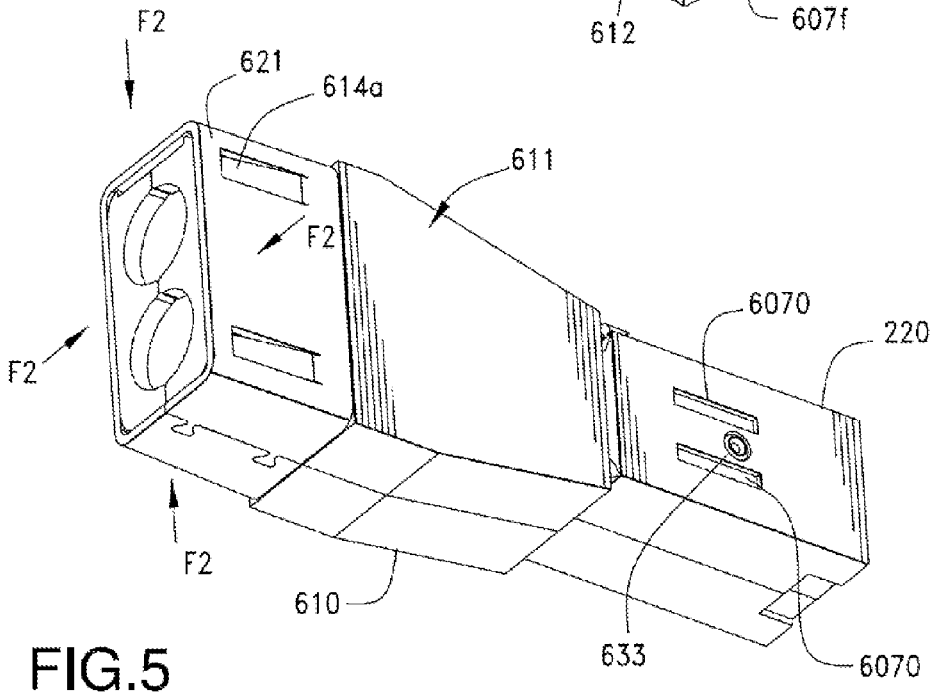
FIG. 5 is a rear perspective view of FIG. 2, taken from the rear underside thereof, with the cables and actuator removed for clarity.

The engagement tabs 614*a* assist in retaining the collar portion 621 on the connector housing body portion 604. The connector housing body portion 604 includes a plurality of recess, or slots 614*b* that are formed in the outer surface thereof and these recesses correspond in number to the slot of the engagement tabs 614*a* such that a single engagement tab is received in a single recess 614*b*. The recesses 614*b* have shoulders 618 that serve as stop surfaces against which the engagement tab free ends 619 bear. This confronting relationship serves to retain the collar portion in place within the channel proximate to the end of the body portion 604. As shown in FIG. 4, the recesses 614*b* may have a variable depth, which increases toward the rear of the recess at the shoulder 618. This interference retains the collar portion in place on the connector housing and prevents it from being disengaged when the connector is connected or disconnected from a device. The engagement tabs and recesses are preferably disposed toward the corners or the free ends of their respective retainers. In this regard, the retainer 620 may be considered as affixed to the connector housing in as much as to remove it, one would need to pry it off or apart. Additionally, the structure and orientation of the engagement tabs and recesses is such that the retainer may be either formed as it is applied to the connector housing, or formed first and then press fit over the end of the connector housing 601 in the channel 625.

Figure 2:
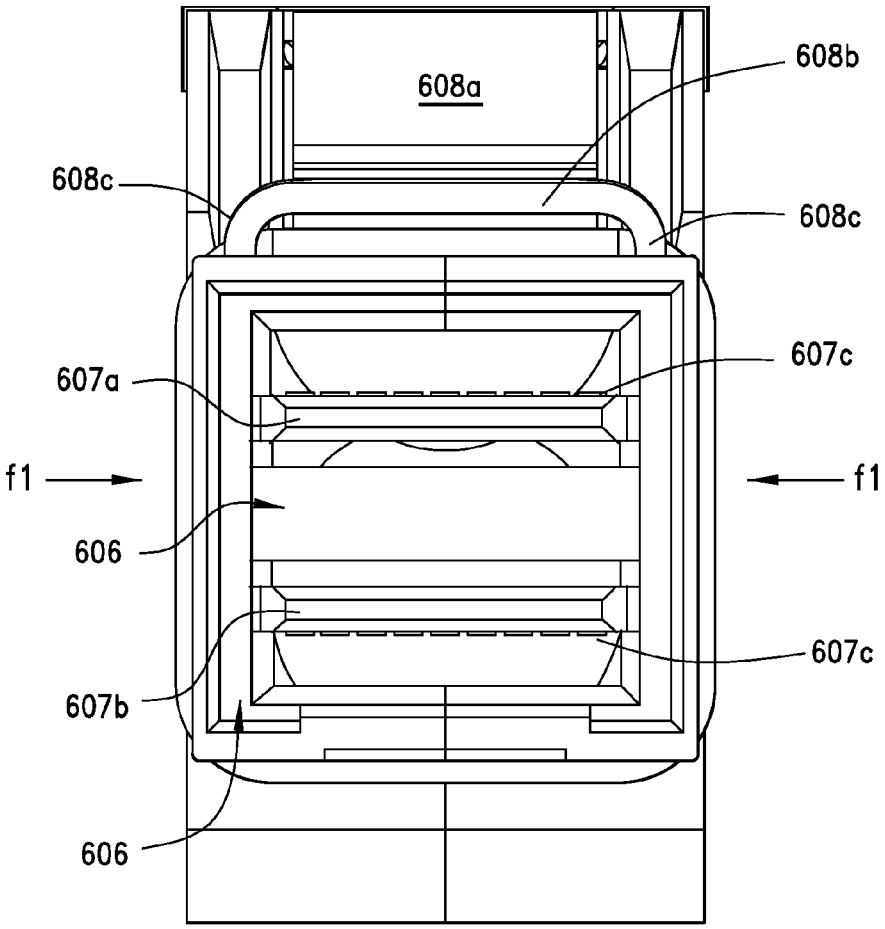
FIG. 2 is a front elevational view of the connector of FIG. 1.
Figure 3:
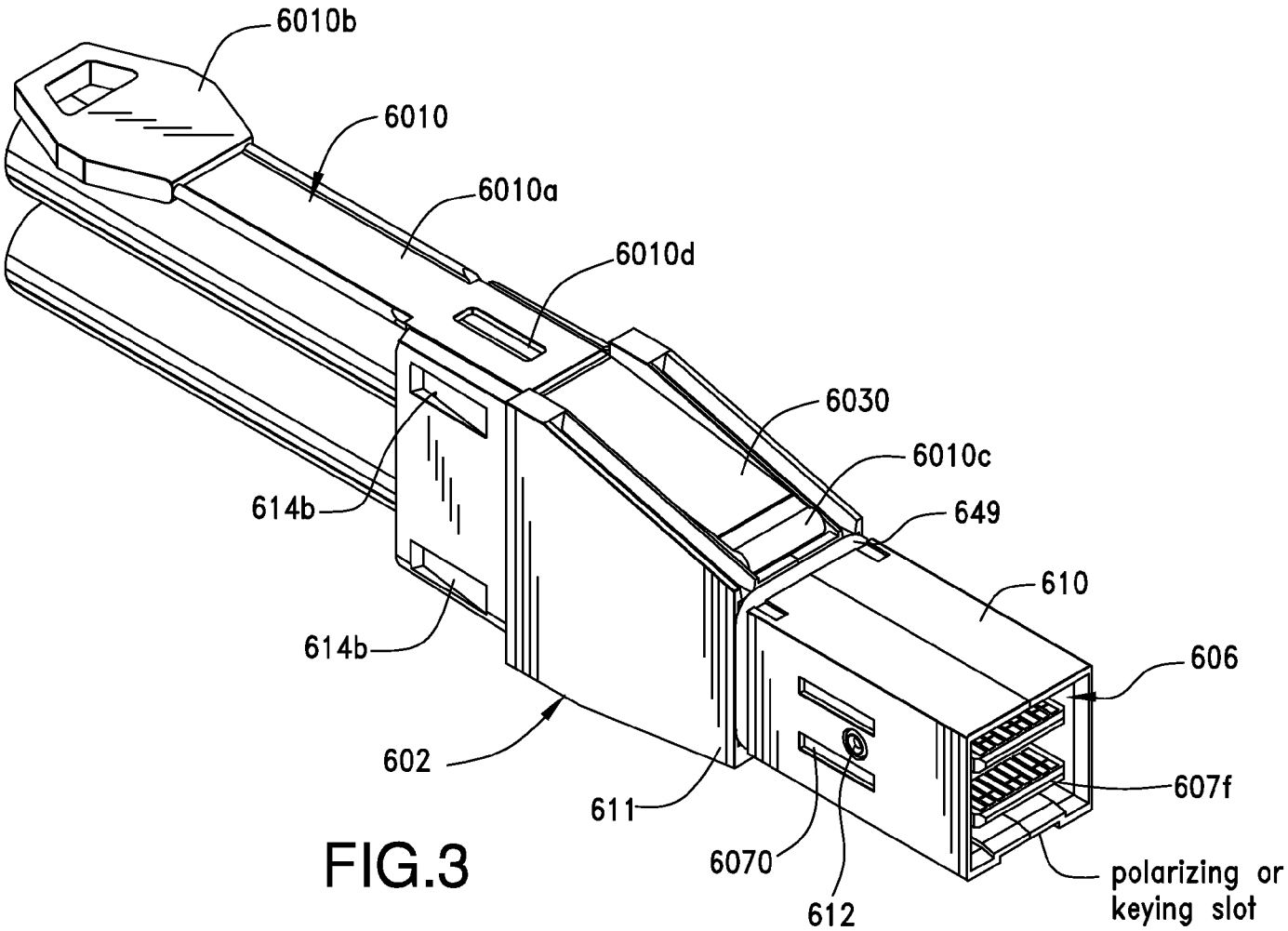
FIG. 3 is the same view as FIG. 1 but with the latching assembly and retaining collar removed for clarity.
Figure 3A:
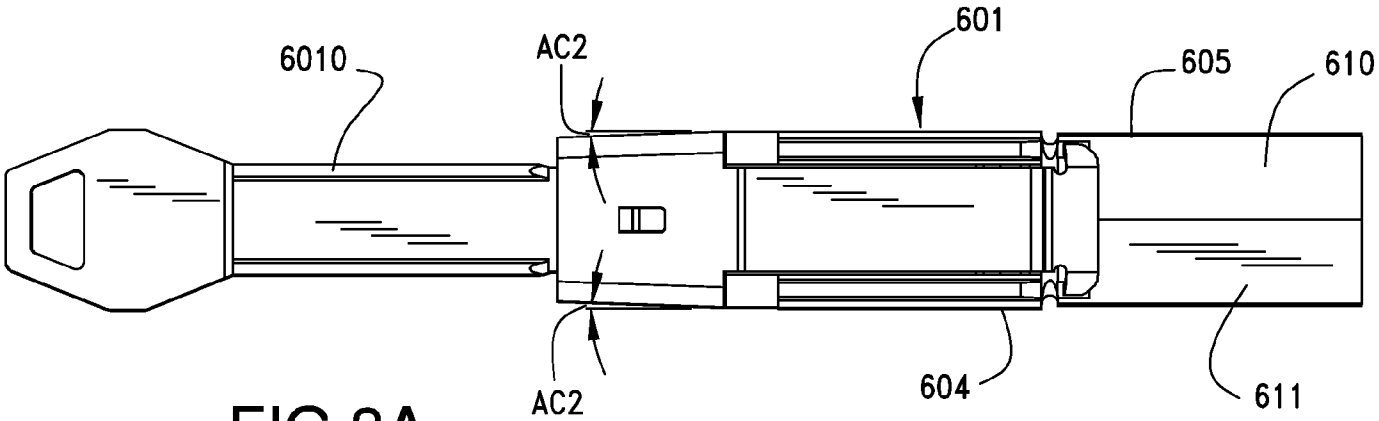
FIG. 3A is a top plan view of the connector of FIG. 3.
Figure 3B:
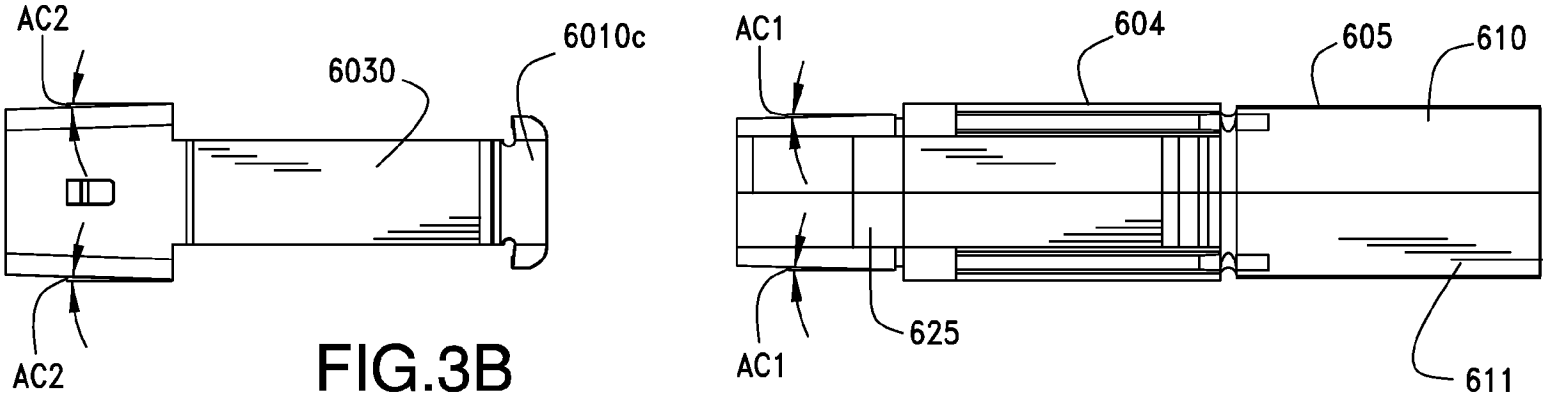
FIG. 3B is the same view as FIG. 3A, but with the actuator removed and the latch member spaced from the connector housing for clarity.

As shown in FIGS. 1-3, the connector 600 also may include a manipulatable latching member 608 that has a longitudinal latching arm 608*a* that terminates in a free end 608*b* with a pair of latching hooks 608*c* disposed thereon and spaced apart from each other in the widthwise direction. The general structure of such a latching member are shown in U.S. Pat. No. 7,281,937, issued Oct. 16, 2007, owned by the assignee of the present application and hereby incorporated in its entirety by reference. These latching hooks 608*c* are received in corresponding openings formed in the housing of an opposing mating connector (not shown). The latching arm 608*a* extends longitudinally of the connector body portion 604 and preferably along the top side thereof and has a given lengthwise extent 603. (FIG. 3.) An actuator 601 is provided for operation of the latch member and it has an elongated, longitudinal body portion 601*a* that has a pull or push tab 6010*b* at one end thereof and a cam surface or member 601*c* at the opposite end thereof. The pull tab 6010*b* can have an opening and could include steps that make it easier to pull/push the pull tab 6010*b*. The actuator body portion 601*a* may include a guide that serves at least to partially retain the actuator 601 in place on the connector 600 and this guide is shown in the Figures as a slot 601*d* that engages a lug or the like formed on either the connector housing body portion 604, or as shown in the drawings, a lug 608*e* that is formed on the latching member 608 on the collar portion 608*d* thereof.

FIGS. 8-15 illustrate a tandem style connector 635 constructed in a accordance with certain embodiments. As depicted, a center piece 640 is provided and mates with the left and right housing halves 610, 611 to increase the size of the connector, widthwise and to provide a pair of hollow mating portions 605 that extend out from the body portion 604. Each mating portion 605 contains a pair of circuit cards 607*a*, 607*b*, 607*a*' and 607*b*'. Not only is it preferred that the circuit cards in each pair be parallel (i.e. lie in parallel planes), but it is also preferred that the circuit ends of the two different pairs lie in respective planes (i.e. cards 607*a* and 607*a*' lie in the same place, while cards 607*b* and 607*b*' lie in another plane), meaning the circuit cards of each pair lie in this different, parallel planes, while the circuit cards of each pair are coincident with their counterparts in the other pairs.

Figure 21:
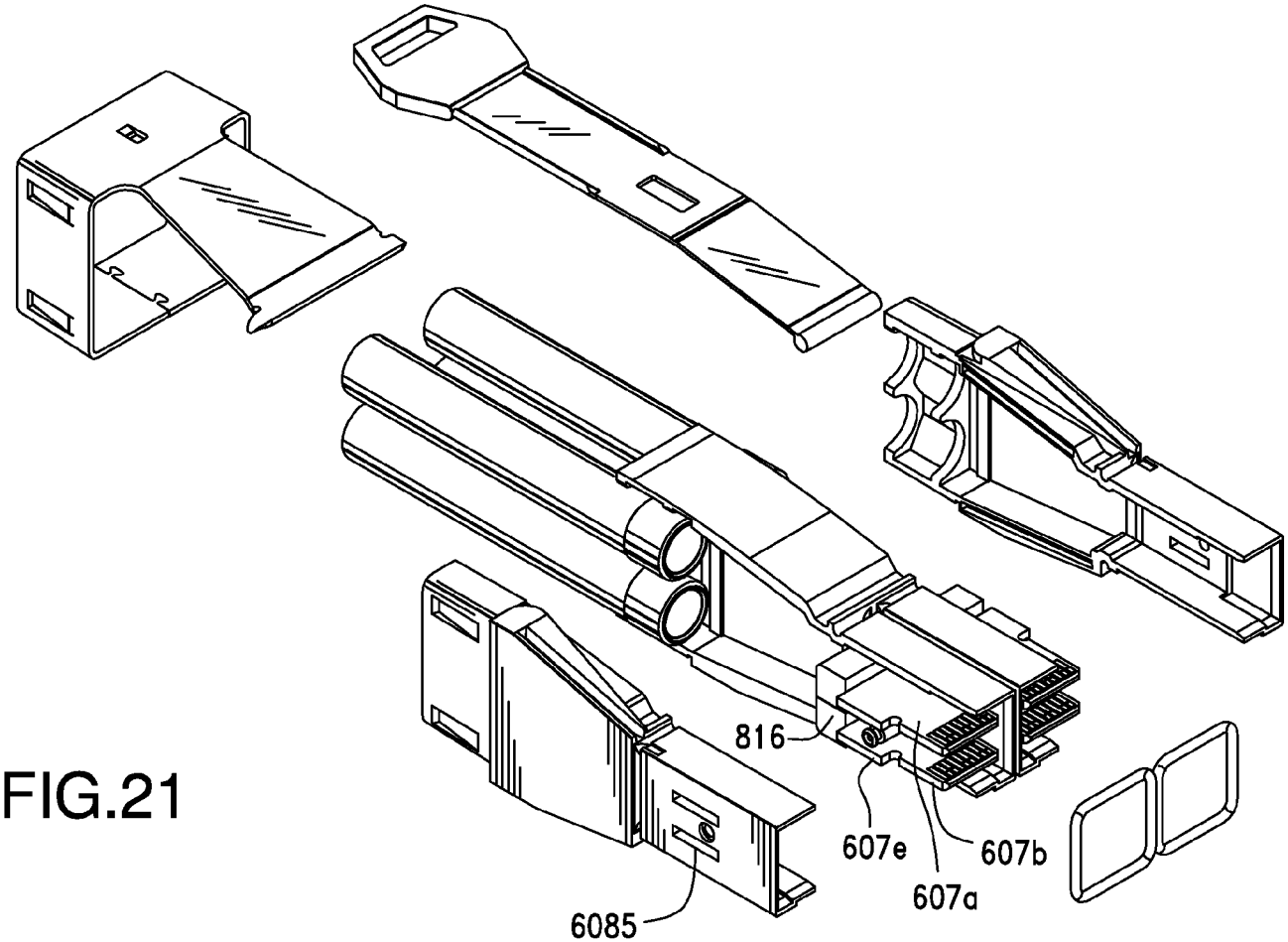
FIG. 21 is the same view as FIG. 19, but with the left and right housing pieces, and the EMI gaskets removed for clarity.
Figure 22:
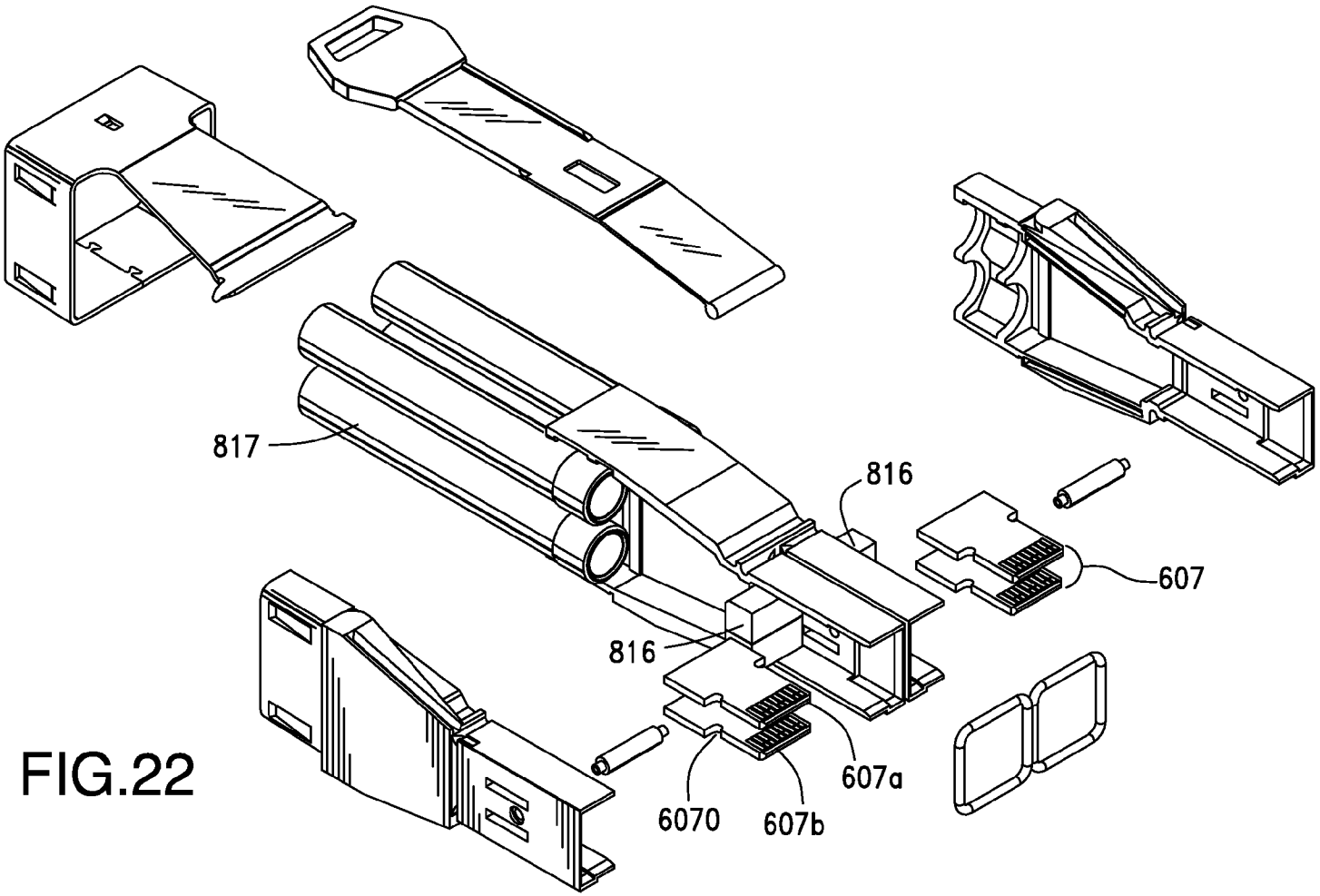
FIG. 22 is the same view as FIG. 21, but with the internal components removed for clarity.

The two mating portions 605 are separated by an intervening slot 642 that extends rearwardly from the front edges thereof to the front wall 644 of the body portion 604. This slot 642 permits both mating portions 605 to be hollow enclosures, with sidewalls 646 and top and bottom walls 647, 648, respectively, but it also serves other purposes. For example, the multi-functional slot 642 can receive a dividing wall 1002 that separates two adjacent hollow bays 1004, 1005 of a 1×4 receptacle connector assembly 1000 (FIG. 8A) to which the connector 640 mates such that the two adjacent mating portions 605 are received within adjacent bays 1004, 1005. It also provides a channel that receives portions of either a pair of EMI gaskets 649 (FIG. 21) or a two-hole single gasket (not shown). Still further, the slot 642 can provide a slot opposing the free end 633 of the front fastening posts 630, into which a plate can be inserted to act as a reaction surface when swaging the front fastener lugs 631 so that the swaging process does not cause the fastening posts to break through the inner sidewalls 646 of the center piece 640. Lastly, the center slot 642 also communicates with a peripheral groove 650 that extends entirely around the mating portion(s) and which receives the gasket 649.

Figure 23:
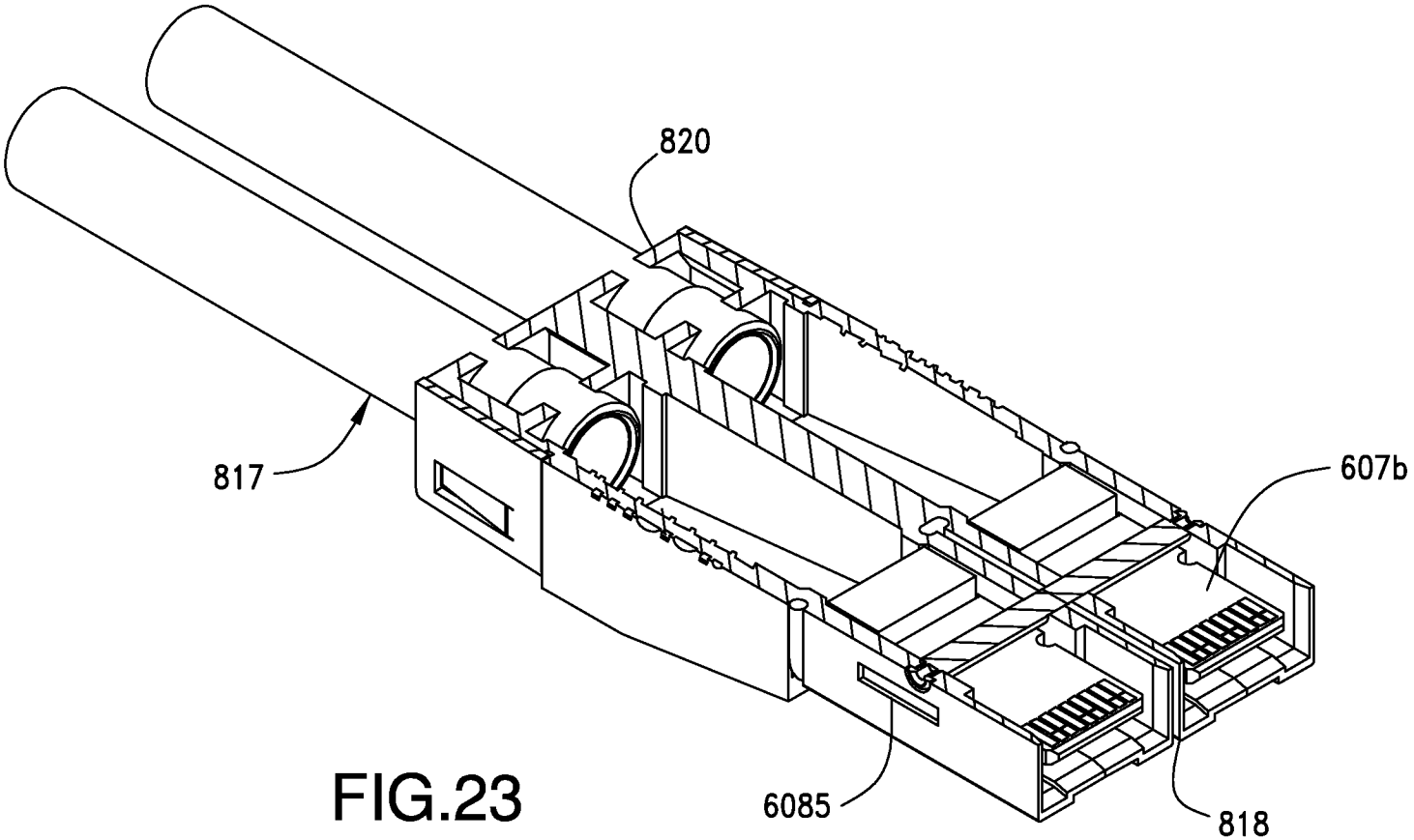
FIG. 23 is a horizontal sectional view of FIG. 19 taken along lines 23-23 thereof.
Figure 24:
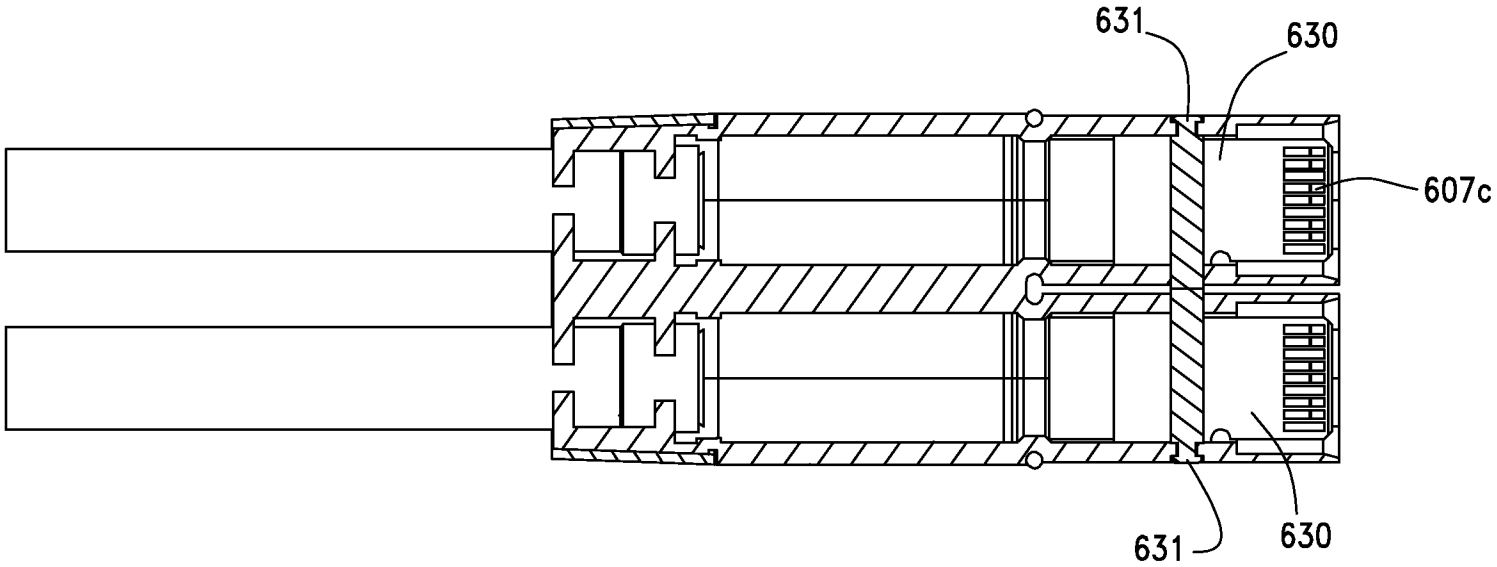
FIG. 24 is a top plan view of FIG. 23.

The center piece 640 has opposing mating faces 652 (FIG. 13) that abut against confronting surfaces of the two housing halves 610, 611. The connector housing may be provided with a rear bulkhead 652 that has a plurality of cable support walls 651, each of which contains grooves 653 that are provided to grip the cables 615 and hold them in the desired vertical orientation. The walls 651 are spaced apart from each other to provide measure of strain relief to the cables 615. As shown in FIG. 23, it is preferred that the cable groove 653 be aligned with the front fastening posts, meaning that one cable 615 should be located just about above the elevation of the front fastening post(s) 630 and the other cable below. This effectively splits the interior cavity 602 into two equal areas for the cable wires 616 to run to the circuit cards 607*a*, 607*b*. Inasmuch as the cable wires 616 are much smaller than the cables 615. The trapezoidal configuration provides the most interior space for the wires and circuit cards and the smallest overall size for the connector.

As illustrated, the connector 600 may include a latching assembly 660 that has a latching arm 661 with a width sufficient to extend across most of the two mating portions 605. Accordingly, the pull tab 662 has a double width as well and may include a pair of finger-receiving holes 663.

Figure 16:
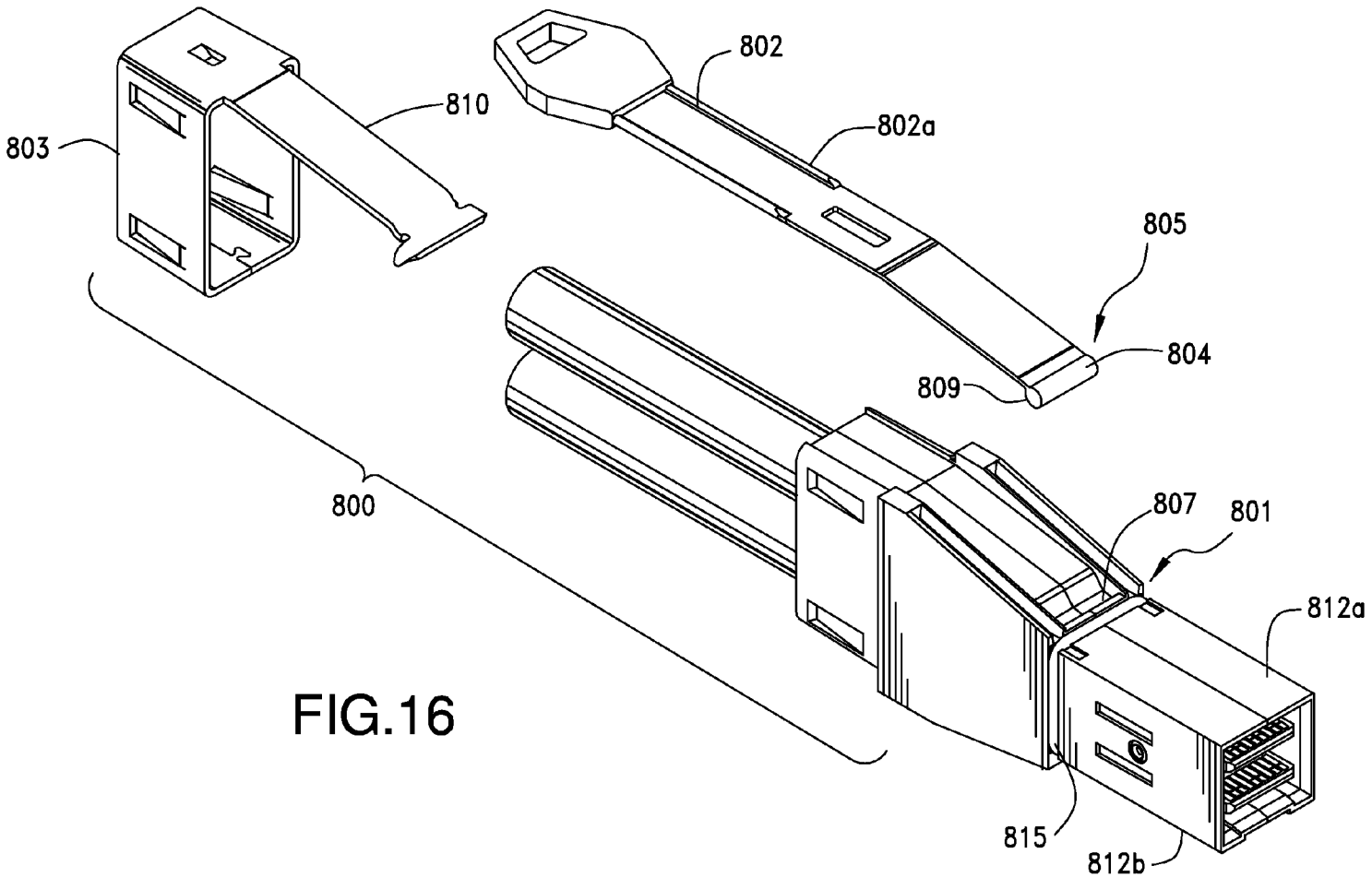
FIG. 16 is a partially exploded view of another connector, better illustrating the latching assembly and the connector housing.
Figure 17:
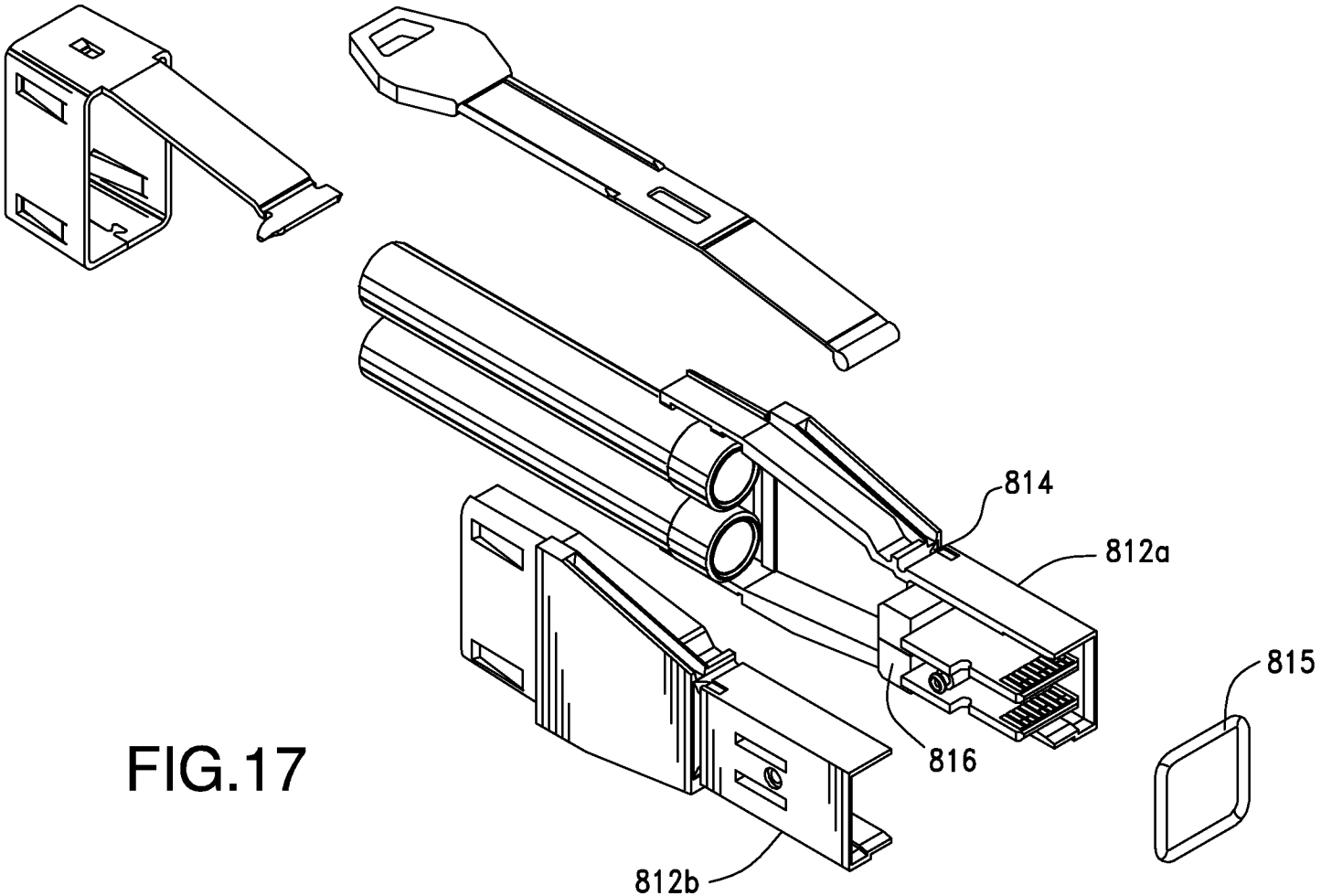
FIG. 17 is the same view as FIG. 16, but with the gasket and right side housing half removed for clarity.
Figure 18:
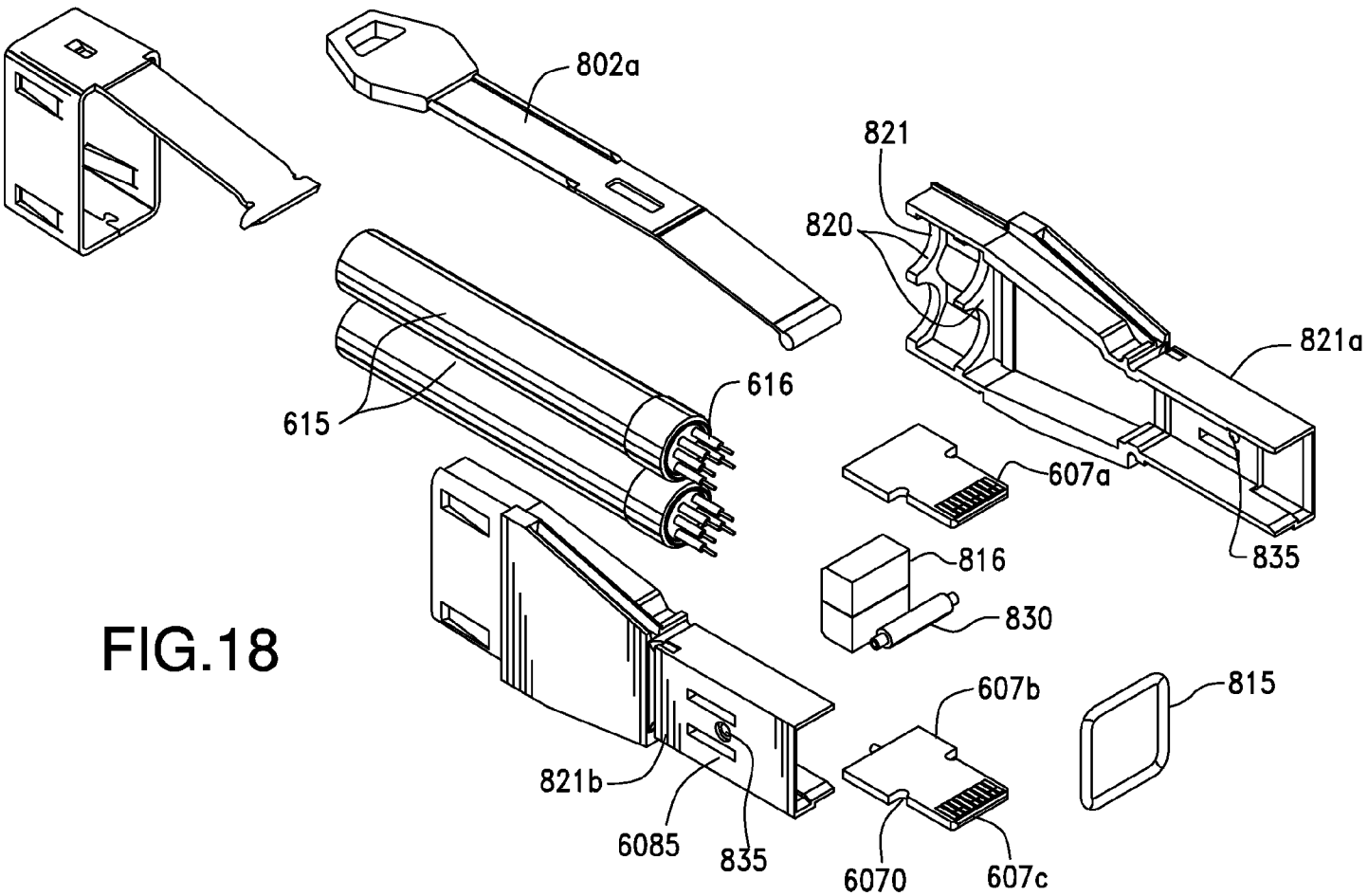
FIG. 18 is an exploded view of the connector of FIG. 17 illustrating the internal components thereof.
Figure 19:
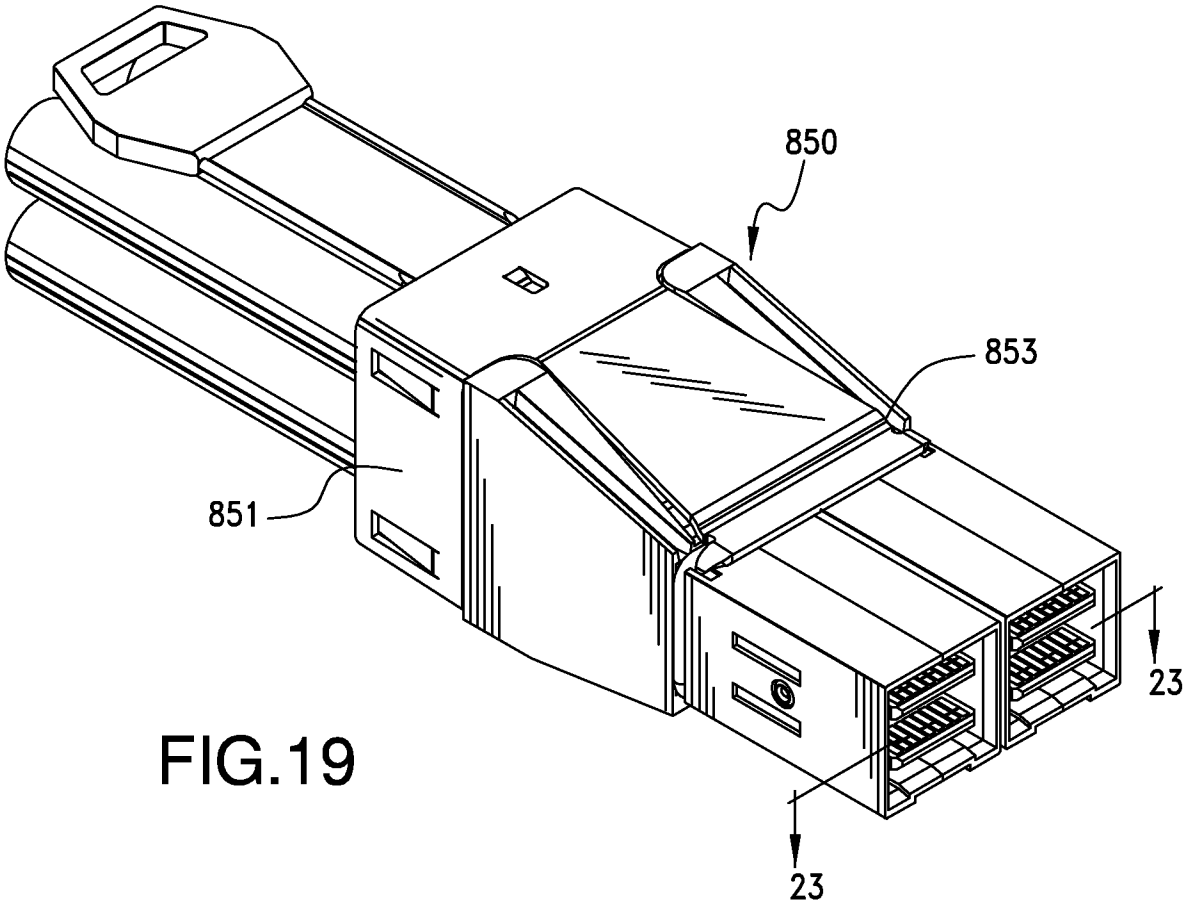
FIG. 19 is a perspective view of another embodiment of a tandem connector.

FIGS. 16-18 illustrate another connector 800 of the invention that utilizes a housing 801, actuator 802 and latching assembly 803. In this embodiment, the actuator 802 has a pair of ribs 802*a* added to it for stability. It has a cam member 804 at its leading end 805 and the connector housing 801 has a recess 807 that receives the cam member 804. The cam member 804 is shown in the form of a cylindrical roll pin 809, although other shapes may be used. Both the actuator 802 and the latching collar latching arm 810 are received within a channel formed in the top of the connector housing 801.

The two housing halves 812*a*, 812*b* are joined together along a line that is coincident with the housing centerline and it will be understood that the top and bottom portions of this mating may be offset so as to provide another measure of interfitting. The housing 801 may be grooved at 814 to receive an elastomeric or other style gasket 815 for EMI reduction. The housing may contain one or more blocks 816 that serve as stops for the circuit cards 607 or as premolded supports for free ends of the wires (not shown) exiting the cables 817. This embodiment also utilizes an insulator fastening post 830 that has two opposing ends, each with a swaging lug 833 disposed thereon. The post 830 is inserted between the mating portion sidewalls of the connector 800 so that their lugs 833 extend through corresponding holes 835 in the sidewalls and then both lugs are swaged.

FIGS. 19-26 illustrate another embodiment of a tandem connector 850 that has a retaining collar 851 with a latching arm 852 also of a longer width. The latching arm 852 has an expanding extent in that its width grows from a narrow width at $w_1$, at the top of the latching arm to a wider width of $w_2$ at its free end 853 as shown best in FIG. 20. The narrow upper part of the latching arm facilitates operation of the latching member and serves to reduce the pull or pushing force required.

Figure 20:
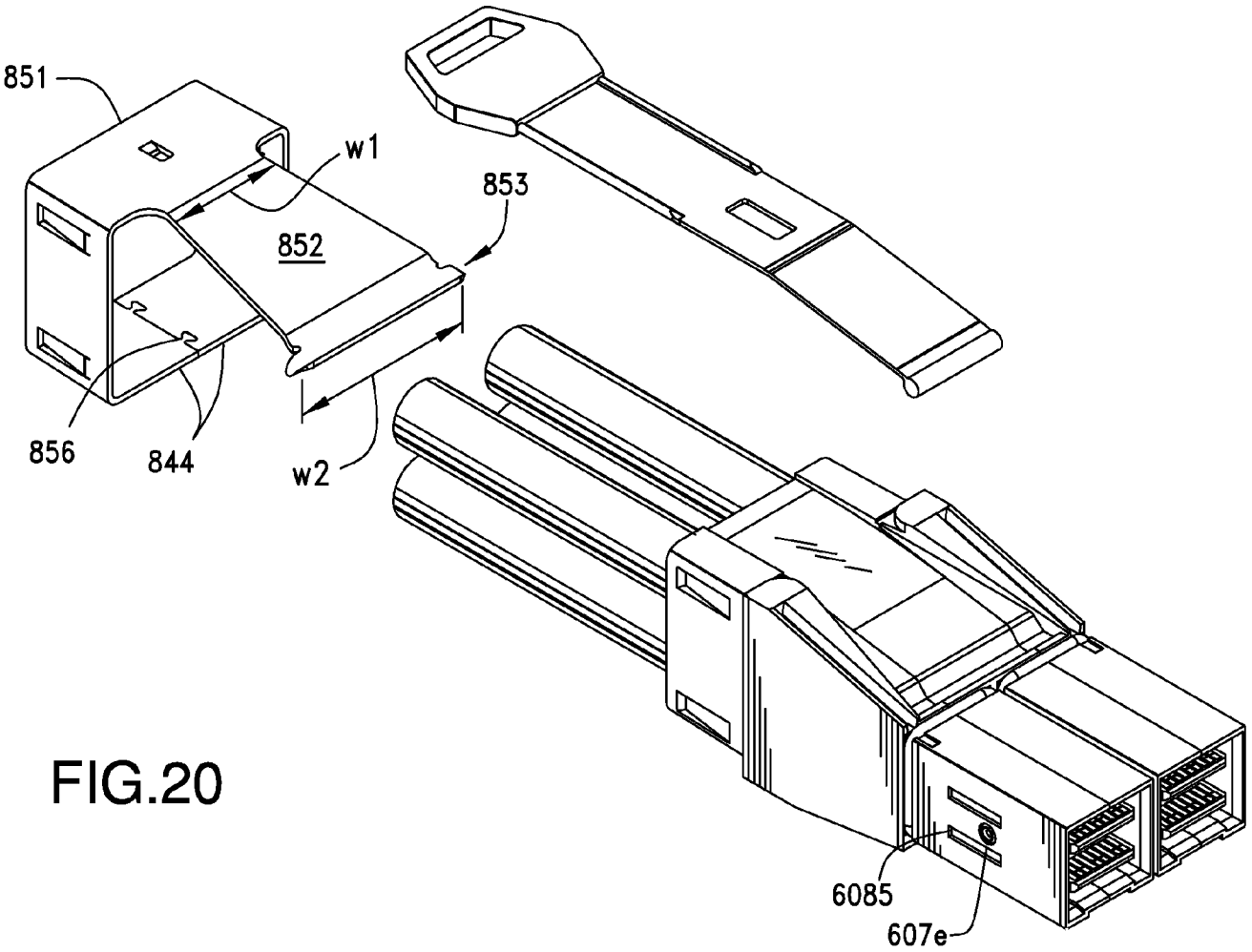
FIG. 20 is the same view as FIG. 19, but with the latching assembly and actuator removed for clarity.

As can be seen in FIG. 20, the retaining collar 851 is stamped and formed as evidenced by its manner of construction. The entire assembly is stamped from a single sheet of metal. The stamped part has two free ends 854 that are joined together by a dovetail arrangement 856.

As in the other tandem embodiment, the front fastening members 612 are shown as interposed between the top and bottom circuit cards 607*a*, 607*b* and two such fasteners in the form of posts 630 are used to hold the housing halves together at the nose portion.

With this type of horizontal structure, cost of assembly as well as inventory of parts can be reduced. The right and left housing halves are preferably mirror images of each other so that in order to assemble multiple bay connectors only right, left and center prices are required to form a two bay tandem-style connector. Additional bays may be added by using additional center pieces. For example, two center pieces and a right and left piece can be combined to form a three bay plug connector. Additional center pieces can be used to expand the number of mating portions and using the disclosed configuration, the number of bays (mating portions) can always be one more than the number of center pieces.

The trailing edge of the housing 801 is slotted and provided with pairs of ribs 820 that are configured to grip the ends of the cable 817 in two places. The ribs 820 are configured with recesses 821 that are preferably complementary to the cable shape.

Figure 25:
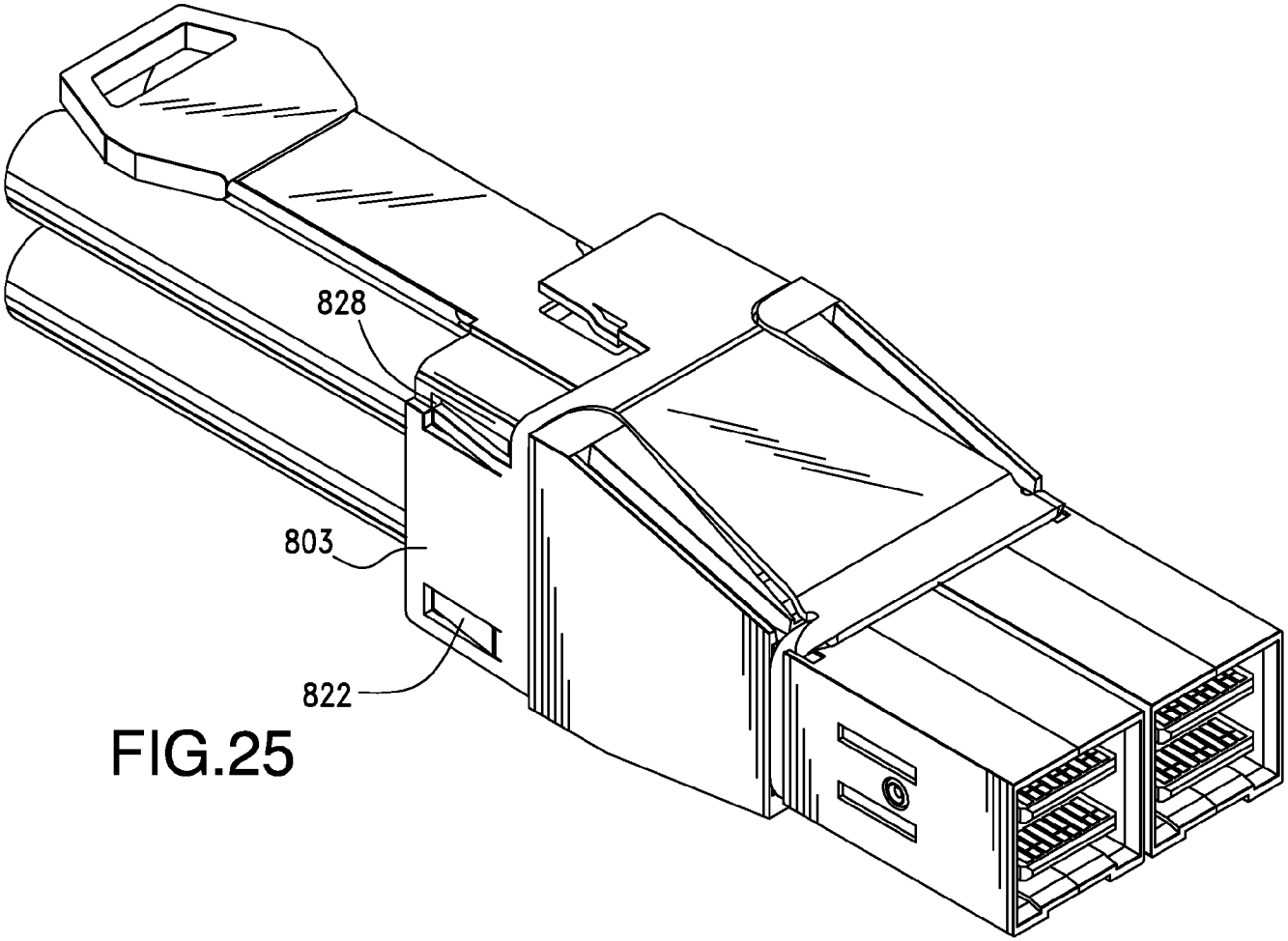
FIG. 25 is a view similar to FIG. 19 with a portion of the latching assembly retaining collar removed to illustrate its engagement with the actuator and connection housing body portion.
Figure 26:
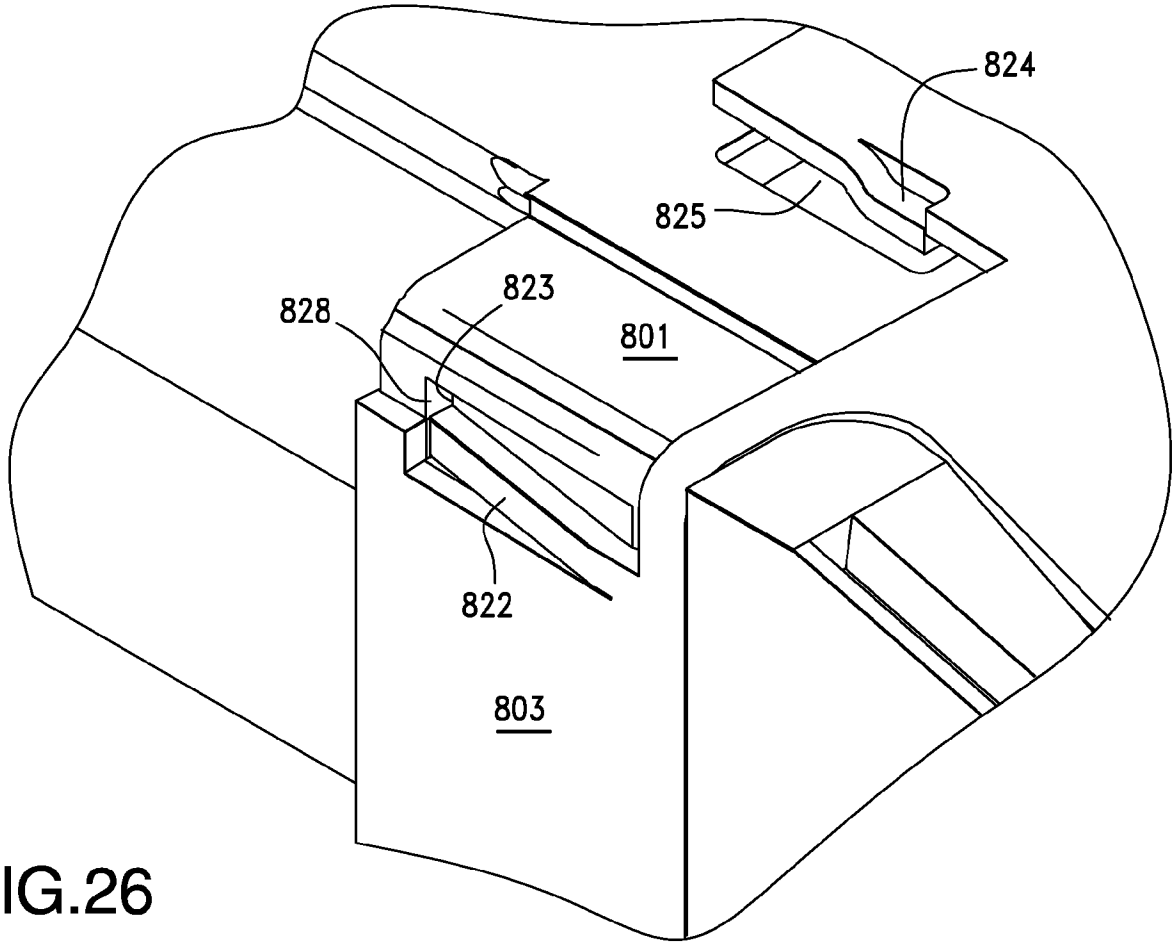
FIG. 26 is an enlarged detail view of the retaining collar of the latching assembly of FIG. 25.
Figure 27:
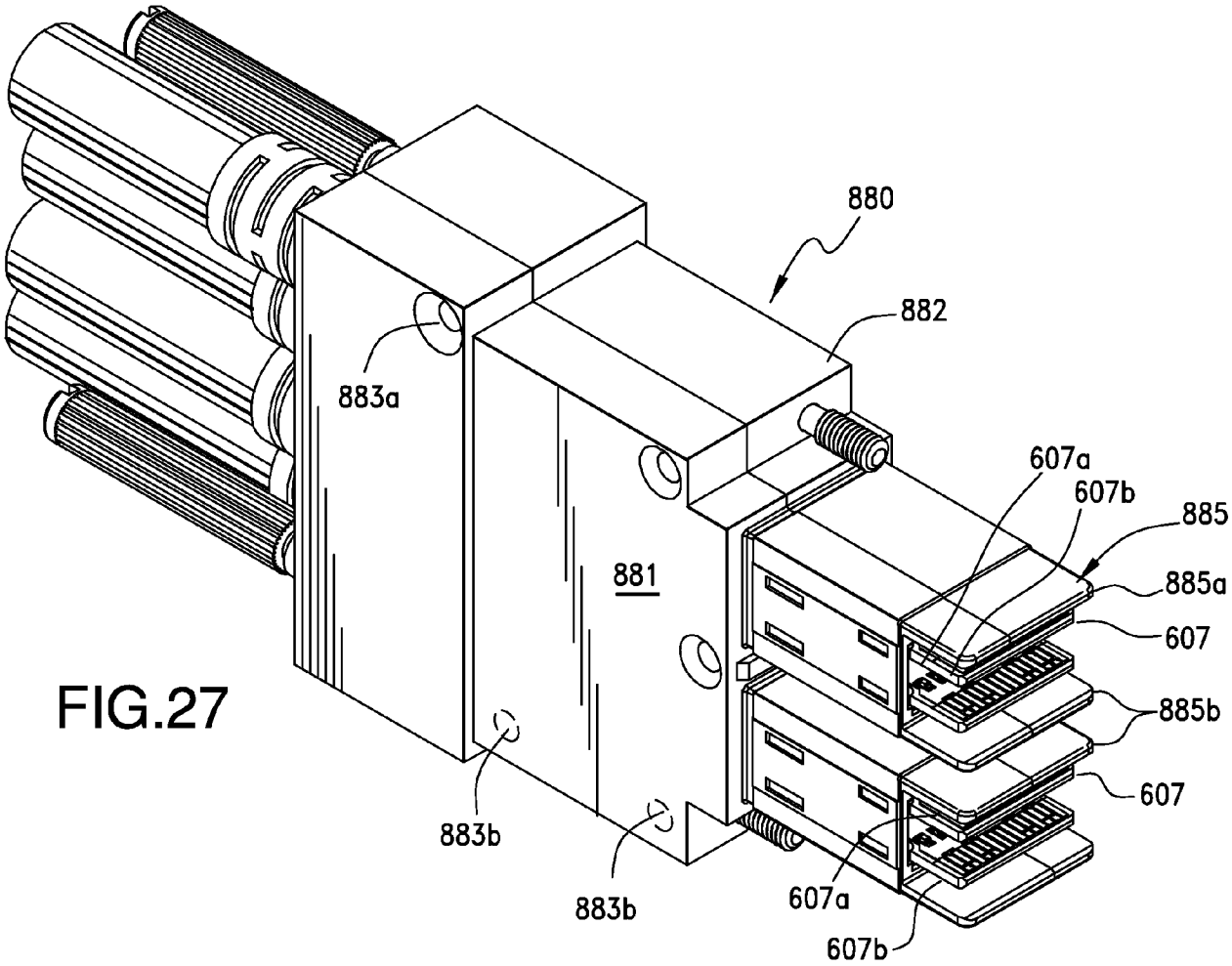
FIG. 27 is a perspective view of another embodiment of a connector of the invention.
Figure 28:
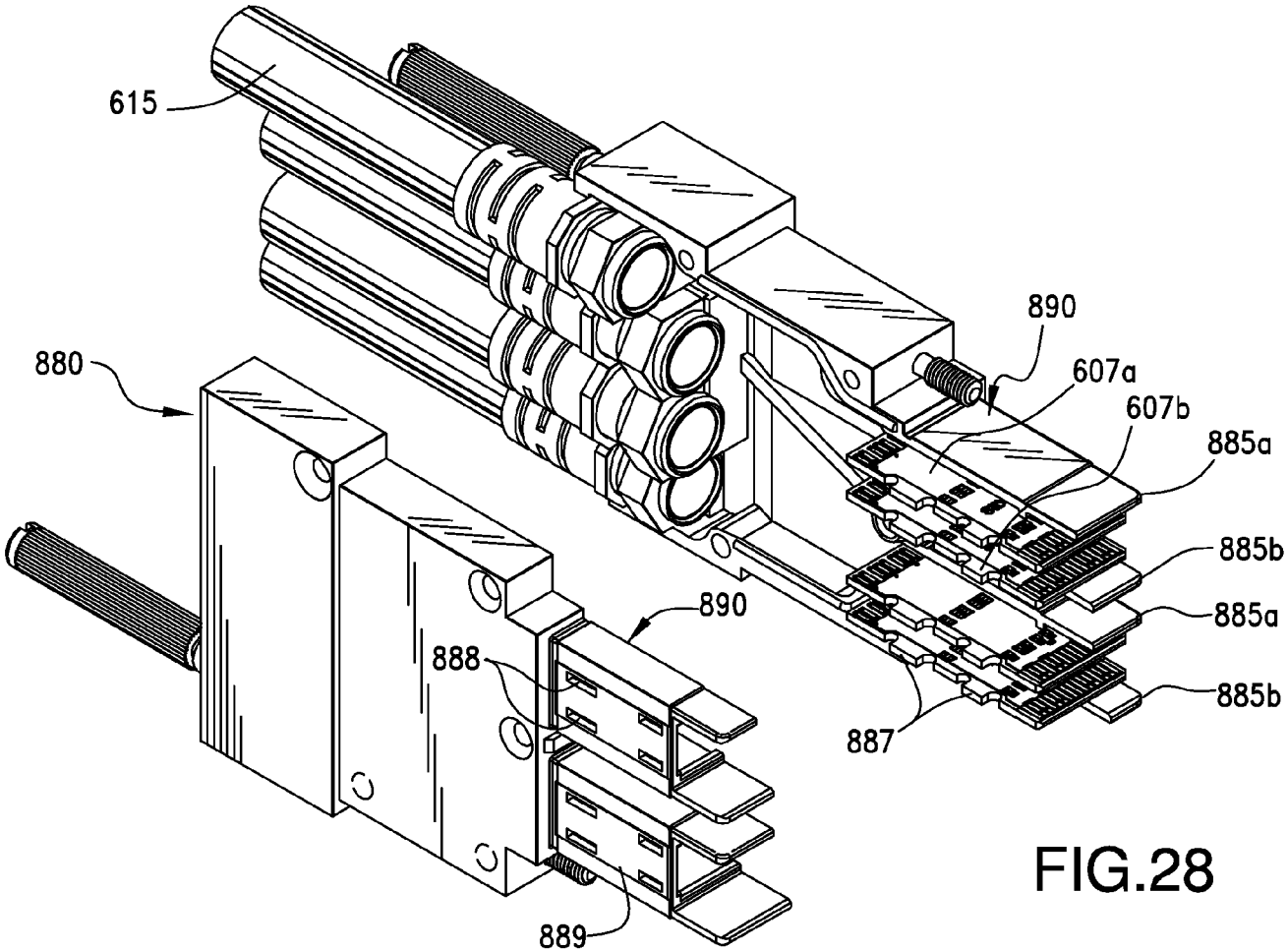
FIG. 28 is an exploded view of the connector of FIG. 27.
Figure 29:
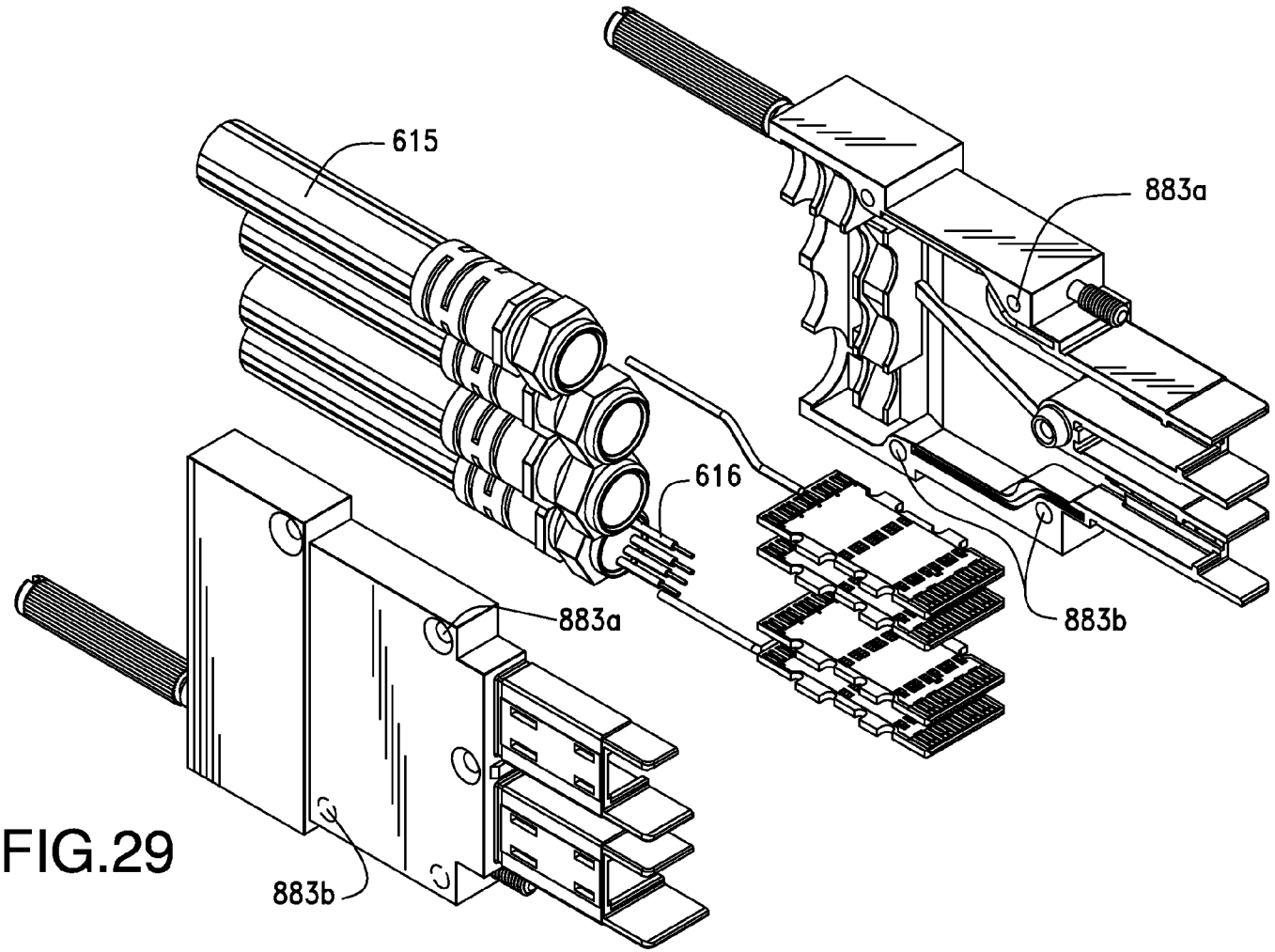
FIG. 29 is the same view as FIG. 28, but with the cables and circuit cards removed from the left hand housing for clarity.
Figure 30:
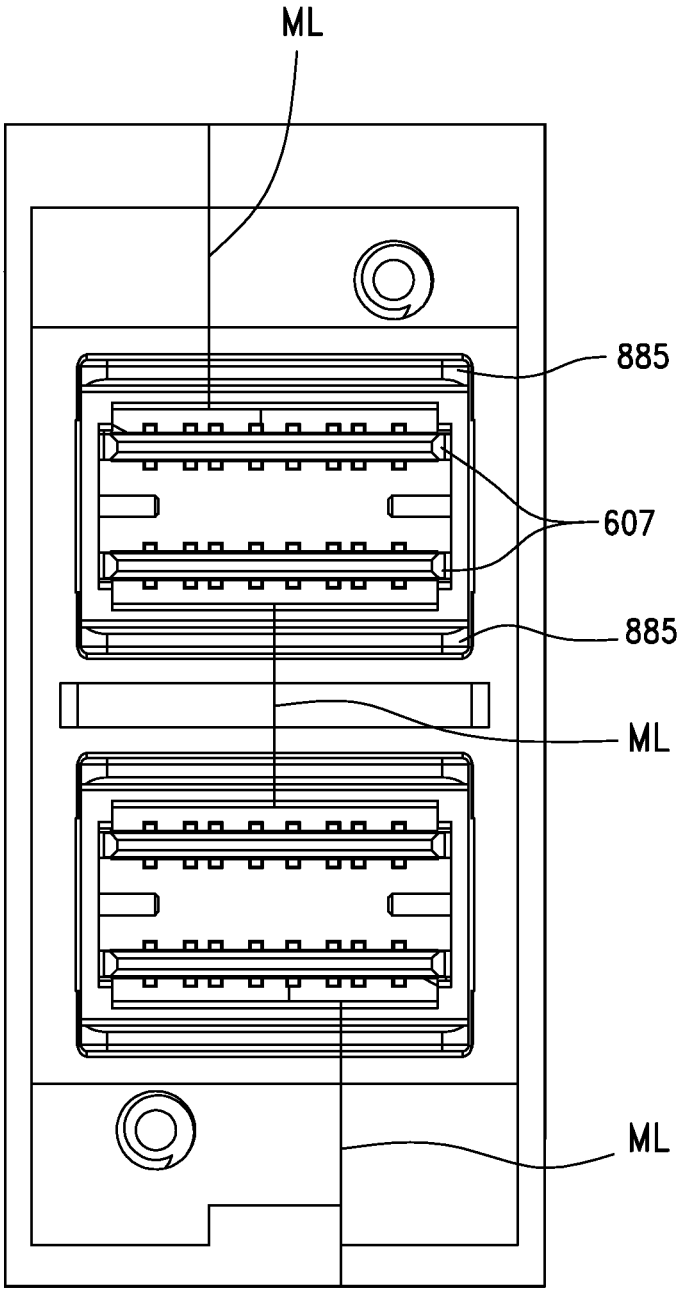
FIG. 30 is a front elevational view of the connector of FIG. 27.
Figure 31:
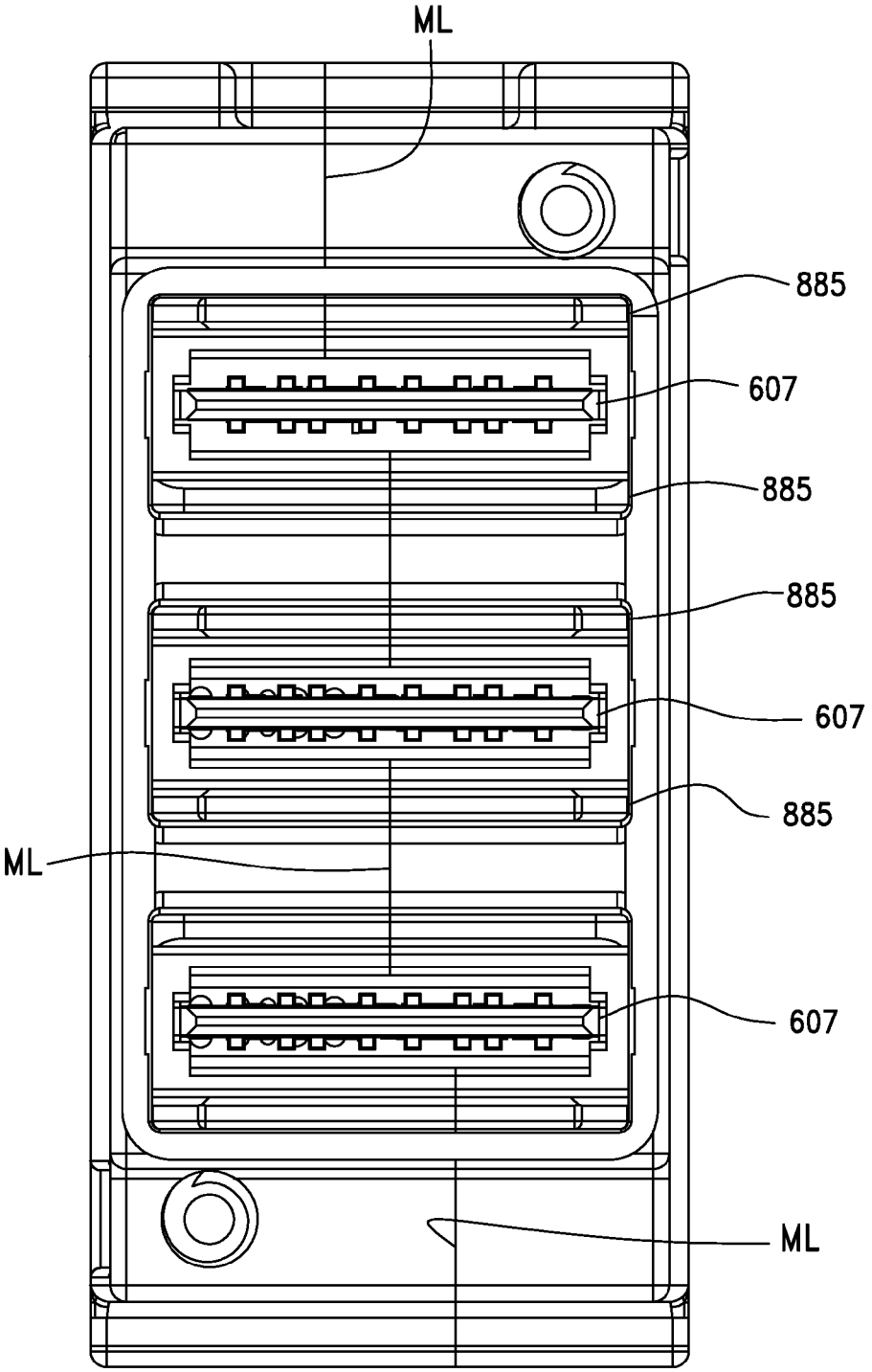
FIG. 31 is an alternate front end that may be used in conjunction with the depicted embodiments.

As shown in FIGS. 25-26, the latching assembly retaining collar 851 is punched, or stamped, to form engagement tabs 822 that are bent inwardly and which are received within corresponding slots 823 that are formed in the exterior surfaces of the connector housing 801 on the collar-mounting channel or recess 675 thereof. The free end of each engagement tab 822 is seen to abut a wall, or shoulder 828 of the housing slot 823 and the tab 822 serves to retain the collar 803 in place upon the connector housing 801. Likewise, the collar 803 may have an additional tab 824 that is disposed in its top portion and which depends through a opening 825 disposed in the actuator so as to retain it in place on the connector housing 801 in a permanent fashion. The collar 803 may also be dimensioned slightly smaller or the same as the trailing edge of the connector housing 801 so as to provide a tight interference fit on the connector housing and exert a fastening pressure on the multiple pieces that make up the housing.

FIGS. 27-31 illustrate another embodiment of a connector 880 that has two sides, or housing halves 881, 882 that are fastened together by screws or similar fastening means in holes 883 that are arranged in a pattern that approximates the perimeter of the connector housing. The holes are provided in both of the two housing halves 881, 882 so that fasteners may be inserted in the holes 883*a* of the right housing half 881 and the holes 883*b* shown is phantom of the left housing half 882, so that an even, balanced fastening force is applied.

In this embodiment, the connector supports multiple pairs of circuit cards 607, in a vertical mating arrangement. The circuit cards 607*a*, 607*b* have leading edges serve as mating blades for the connector and which are partly protected by pairs of flanges 805, a pair of flanges 805 being disposed on the tops and bottoms of each circuit card pair. The flanges 885 may be made so that they have different projecting lengths. In the embodiment shown, the top flange 885*a* is shorter than bottom flange 885*b* and this permits the lower flanges 885 of each pair of circuit cards 607 to serve as keys for mating with an opposing connector. In this embodiment, as well as the embodiment of FIGS. 1-16, it is preferred to have the key disposed on the bottom flange, either using the flange itself as at 885*b* in the embodiment of FIGS. 26-31, or forming a recess, or ridge 900 as shown in FIGS. 1-16.

The circuit cards 607*a*, 607*b* of this embodiment also may include wings 887 that are received in slots 888 formed in the sidewalls 889 of the mating portions 890 of the connector 880. In this manner, the circuit cards of each pair of cords may be disposed parallel to each other and parallel to the other pairs of circuit cards.

It will be understood that there are numerous modifications of the illustrated embodiments described above which will be readily apparent to one skilled in the art, such as many variations and modifications of the connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

What is claimed is:

1. A connector, comprising:

a connector housing, the connector housing having at least first and second housing portions that are mated together along a mating line that is mostly vertical to define a hollow enclosure, the connector housing including a body portion and a mating portion, the body portion having a first height and the mating portion having a second height, the body portion being larger than the mating portion and the first height being greater than the second height;

a first and second mating blade positioned in the hollow enclosure, each of the mating blades including opposing leading and trailing edges, the first and second mating blade leading edge extending toward the mating portion, and the first and second mating blade trailing edge extending toward the body portion, the connector housing mating portion at least partially enclosing the mating blades; and a retainer that engages the connector housing in a clamping manner to hold the first and second housing portions together.

2. The connector of claim 1, wherein the retainer includes a continuous collar that encircles the connector housing.

3. The connector of claim 2, wherein the connector housing includes a plurality of slots disposed under the collar and the collar includes a plurality of engagement tabs that project inwardly so as to engage the plurality of slots.

4. The connector of claim 3, wherein the collar includes four corners and the engagement tabs are disposed on the collar proximate to one or more of the four corners.

5. The connector of claim 2, further including a latching member extending longitudinally from the collar in a cantilevered manner.

6. The connector of claim 1, further comprising a fastening member that applies a horizontal fastening force to the first and second housing portions widthwise with respect to the connector housing.

7. The connector of claim 1, wherein the first and second mating blade have a leading edge with contacts and an opposing trailing edge, the first and second mating blade having a first width at the leading edge and a second width between the leading edge and the trailing edge, the second width being greater than the first width, the second width of the mating blade engaging the connector housing so as to maintain the mating blades in the desired position.

8. The connector of claim 7, wherein the second width is formed by two wings that engage two slots in the connector housing.

9. The connector of claim 1, wherein the connector housing body portion includes a channel extending around its perimeter and the retainer is received within the channel.

10. The connector of claim 1, wherein a portion of the connector housing engaged by the retainer has a first taper and the retainer has second taper, the first and second tapers being different such that the retainer elastically deforms when applied to the connector housing.

11. The connector of claim 1, wherein the body portion has an aperture opposite the mating portion, the aperture configured to receive a cable.

12. A connector, comprising:

a connector housing including a first and second housing portions, the first and second housing portions being mated together along respective opposing mating surfaces that form a substantially vertical line, the connector housing including an enlarged body portion and a narrow mating portion, the enlarged body portion and the narrow mating portion having respective first and second heights, the first height being greater than the second height;

a retainer extending around at majority of a perimeter of the enlarged body portion, the retainer configured to clamp the first and second housing portions together;

a fastener positioned in the narrow mating portion and configured to clamp the first and second housing portions together; and a first and second mating blade horizontally positioned in the narrow mating portion and extending into the enlarged body portion, the first and second mating blade being vertically spaced apart.

13. The connector of claim 12, wherein the connector housing body portion has at least four distinct sides and the retainer engages at least three sides of the connector housing body portion.

14. The connector of claim 12, wherein the retainer comprises a collar member that encircles the connector housing body portion.

15. The connector of claim 14, where the retainer has an interior circumference that is slightly less than an exterior circumference of the connector housing body portion, whereby the retainer exerts a compressive clamping force on the connector housing body portion.

16. The connector of claim 14, wherein the connector housing body portion includes a circumferential recess and the collar member is disposed in the circumferential recess.

17. The connector of claim 12, wherein the fastener is positioned between the first and second mating blade.

18. The connector of claim 12, further including an intermediate housing portion interposed between the connector first and second housing halves, the intermediate housing portion cooperatively defining, with the first and second housing halves, a first and second mating portion of the connector housing.

19. The connector of claim 18, wherein the connector housing intermediate portion includes a slot that separates the first and second mating portions.

20. The connector of claim 18, wherein the first and second mating portion each supports a pair of mating blades vertically spaced apart from each other.

21. The connector of claim 18, wherein the retainer comprises a collar that that encircles the connector housing body portion and includes a latching member extending longitudinally from the collar in a cantilevered manner toward a free end, the latching member having a first width approximate the collar and a second greater width at the free end.

22. The connector of claim 12, wherein the connector housing comprises a plurality of mating portions vertically spaced apart thereon, each of the mating portions including a pair of mating blades vertically spaced apart from each other.

23. The connector of claim 22, wherein each of the mating portions include a pair of flanges associated therewith, the flanges being disposed above and below each respective pair of mating blades.

* * * * *